US007959422B2

(12) United States Patent
Nakakuki et al.

(10) Patent No.: US 7,959,422 B2
(45) Date of Patent: Jun. 14, 2011

(54) OIL PUMP AND METHOD OF ASSEMBLING THE OIL PUMP

(75) Inventors: Yasuhito Nakakuki, Atsugi (JP); Kaname Kidokoro, Isehara (JP); Tetsuo Abe, Atsugi (JP); Toshimitsu Sakaki, Atsugi (JP); Mitsuo Sasaki, Hadano (JP); Masakazu Kurata, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 658 days.

(21) Appl. No.: 11/954,910

(22) Filed: Dec. 12, 2007

(65) Prior Publication Data

US 2008/0145259 A1 Jun. 19, 2008

(30) Foreign Application Priority Data

Dec. 18, 2006 (JP) ..... 2006-339360

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***B23P 15/00*** | (2006.01) |
| ***B23Q 3/00*** | (2006.01) |

(52) U.S. Cl. ..... 418/61.3; 29/888.02; 29/464; 418/1

(58) Field of Classification Search ..... 418/61.3, 418/1; 29/888.02, 525.01, 525.02, 464, 469
See application file for complete search history.

(56) References Cited

U.S. PATENT DOCUMENTS

| | | | | |
|---|---|---|---|---|
| 2,966,118 | A * | 12/1960 | McAlvay | 418/171 |
| 3,532,447 | A * | 10/1970 | Charlson | 418/61.3 |
| 3,614,274 | A * | 10/1971 | Ohrberg | 418/61.3 |
| 5,328,343 | A * | 7/1994 | Bernstrom et al. | 418/61.3 |
| 6,568,930 | B2 | 5/2003 | Schmidl et al. | |
| 2006/0073060 | A1 | 4/2006 | Kurata et al. | |
| 2006/0210417 | A1 * | 9/2006 | Kurata et al. | 418/61.3 |

FOREIGN PATENT DOCUMENTS

JP 2002-155872 A 5/2002

OTHER PUBLICATIONS

Chinese Office Action dated Jul. 3, 2009 w/English translation (seven (7) pages). includes an English translation of the summary only.

* cited by examiner

*Primary Examiner* — Thomas E Denion
*Assistant Examiner* — Mary A Davis
(74) *Attorney, Agent, or Firm* — Crowell & Moring LLP

(57) ABSTRACT

An oil pump including a first housing having a rotation shaft insertion hole, a cam ring, a pump element, a rotation shaft rotatably extending through the rotation shaft insertion hole, a second housing disposed on the cam ring, wherein the cam ring is placed in a position relative to the rotation shaft insertion hole of the first housing by using a jig, and the cam ring includes a clamped portion that is clamped by a cam ring holding device, while the first housing and the second housing are fixed to each other after placing the cam ring in the position relative to the rotation shaft insertion hole by using the jig. Alternatively, the oil pump including a fixing means for fixing the cam ring to the pump body instead of the clamped portion.

7 Claims, 15 Drawing Sheets

OIL PUMP AND METHOD OF ASSEMBLING THE OIL PUMP

BACKGROUND OF THE INVENTION

The present invention relates to an oil pump that is used as a driving source of a power steering apparatus for vehicles, and a method of assembling the oil pump.

Japanese Patent Application First Publication No. 2002-155872 (corresponding to U.S. Pat. No. 6,568,930) discloses an oil pump that is applied to a power steering apparatus for vehicles. The oil pump of the conventional art includes a pump housing with an annular recess, a cup-shaped cover member opposed to the pump housing, and a rotation shaft that extends through the cover member into the pump housing and is rotatably supported by the pump housing. A cam ring is disposed within an inside space that is defined by the cover member and the pump housing. A pump element constituted of an outer rotor with inner teeth and an inner rotor with outer teeth is rotatably disposed inside of the cam ring. An adjusting device for adjusting a radial gap or clearance between the inner teeth of the outer rotor and the outer teeth of the inner rotor is disposed at a connecting portion of the pump housing and the cover member. The adjusting device includes a groove formed at the connecting portion of the pump housing and the cover member, and an adjusting element that is disposed in the groove and constructed to project from the groove and retreat thereinto in a radial direction of the cam ring. The adjusting element has one end portion fixed to the cam ring. When the adjusting element moves in the radially inward direction of the cam ring so as to project from the groove, the adjusting element presses the cam ring such that the cam ring and the outer rotor are moved in the radially inward direction and thereby the clearance between the inner teeth of the outer rotor and the outer teeth of the inner rotor is adjusted. The thus-constructed oil pump of the conventional art aims to provide the clearance between the inner teeth of the outer rotor and the outer teeth of the inner rotor with accuracy.

SUMMARY OF THE INVENTION

Since the oil pump of the above-described conventional art is provided with the adjusting device in order to ensure the accuracy in providing the clearance between the inner teeth and the outer teeth of the rotors, the construction of the oil pump of the above-described conventional art becomes complicated. This leads to increase in the number of parts and the number of production and assembly processes, thereby causing increase in the production cost.

It is an object of the present invention to solve the above-described problem in the technologies of the conventional art and to provide an oil pump that can provide a clearance between the inner teeth and the outer teeth of the rotors with accuracy by a simplified construction and a method of assembling the oil pump which can be readily performed and ensure the accuracy in providing the clearance between the inner teeth and the outer teeth of the rotors.

The other objects and features of this invention will become understood from the following description with reference to the accompanying drawings.

In one aspect of the invention, there is provided an oil pump comprising:

a first housing having a rotation shaft insertion hole;

a cam ring disposed on the first housing, the cam ring having a generally cylindrical inner circumferential surface;

a pump element that is rotatably disposed within the cam ring and performs suction and discharge of a working oil during rotation;

a rotation shaft that rotatably extends through the rotation shaft insertion hole of the first housing and rotatively drives the pump element; and a second housing disposed on the cam ring on a side opposed to the first housing in an axial direction of the rotation shaft, wherein the cam ring is placed in a position relative to the rotation shaft insertion hole of the first housing by using a jig, and wherein the cam ring includes a clamped portion, the clamped portion being clamped by a cam ring holding device that fixes the cam ring to the first housing in the position relative to the rotation shaft insertion hole, while the first housing and the second housing are fixed to each other after placing the cam ring in the position relative to the rotation shaft insertion hole by using the jig.

In a further aspect of the invention, there is provided an oil pump comprising:

a first housing having a rotation shaft insertion hole;

a cam ring disposed on the first housing, the cam ring having a generally cylindrical inner circumferential surface;

an outer rotor rotatably disposed within the cam ring, the outer rotor having a plurality of inner teeth on an inner circumferential surface thereof;

an inner rotor having a plurality of outer teeth on an outer circumferential surface thereof which are engageable with the inner teeth of the outer rotor;

a rotation shaft that rotatably extends through the rotation shaft insertion hole of the first housing and rotatively drives the inner rotor; and a second housing disposed on the cam ring on a side opposed to the first housing in an axial direction of the rotation shaft, wherein the cam ring is placed in a position relative to the rotation shaft insertion hole of the first housing by using a jig, and wherein the cam ring includes a clamped portion, the clamped portion being clamped by a cam ring holding device that fixes the cam ring to the first housing in the position relative to the rotation shaft insertion hole, while the first housing and the second housing are fixed to each other after placing the cam ring in the position relative to the rotation shaft insertion hole by using the jig.

In a still further aspect of the invention, there is provided an oil pump comprising:

a first housing having a rotation shaft insertion hole;

a cam ring disposed on the first housing, the cam ring having a generally cylindrical inner circumferential surface;

a pump element that is rotatably disposed within the cam ring and performs suction and discharge of a working oil during rotation;

a rotation shaft that rotatably extends through the rotation shaft insertion hole of the first housing and rotatively drives the pump element;

a second housing disposed on the cam ring on a side opposed to the first housing in an axial direction of the rotation shaft; and a fixing means for fixing the first housing and the cam ring to each other, wherein the cam ring is placed in a position relative to the rotation shaft insertion hole of the first housing by using a jig, and wherein the fixing means fixes the first housing and the cam ring to each other after placing the cam ring in the position relative to the rotation shaft insertion hole by using the jig and before assembling the second housing to the first housing.

In a still further aspect of the invention, there is provided an oil pump comprising:

a first housing having a rotation shaft insertion hole;

a cam ring disposed on the first housing, the cam ring having a generally cylindrical inner circumferential surface;

an outer rotor rotatably disposed within the cam ring, the outer rotor having a plurality of inner teeth on an inner circumferential surface thereof;

an inner rotor having a plurality of outer teeth on an outer circumferential surface thereof which are engageable with the inner teeth of the outer rotor;

a rotation shaft that rotatably extends through the rotation shaft insertion hole of the first housing and rotatively drives the inner rotor;

a second housing disposed on the cam ring on a side opposed to the first housing in an axial direction of the rotation shaft; and a fixing means for fixing the first housing and the cam ring to each other, wherein the cam ring is placed in a position relative to the rotation shaft insertion hole of the first housing by using a jig, and wherein the fixing means fixes the first housing and the cam ring to each other after placing the cam ring in the position relative to the rotation shaft insertion hole by using the jig and before assembling the second housing to the first housing.

In a still further aspect of the invention, there is provided oil pump comprising:

a first housing having a rotation shaft insertion hole;

a cam ring disposed on the first housing, the cam ring having a generally cylindrical inner circumferential surface;

a pump element that is rotatably disposed within the cam ring and performs suction and discharge of a working oil during rotation;

a rotation shaft that rotatably extends through the rotation shaft insertion hole of the first housing and rotatively drives the pump element;

a second housing disposed on the cam ring on a side opposed to the first housing in an axial direction of the rotation shaft; and a fixing member that fixes the first housing and the cam ring to each other, wherein the cam ring is allowed to be placed in an optional position relative to the first housing before the cam ring is fixed to the first housing.

In a still further aspect of the invention, there is provided a method of assembling an oil pump, the oil pump including a first housing having a rotation shaft insertion hole, a cam ring disposed on the first housing, the cam ring having a generally cylindrical inner circumferential surface, a pump element that is rotatably disposed within the cam ring and performs suction and discharge of a working oil during rotation, a rotation shaft that rotatably extends through the rotation shaft insertion hole of the first housing and rotatively drives the pump element, and a second housing disposed on the cam ring on a side opposed to the first housing in an axial direction of the rotation shaft, the method comprising:

a first step of placing the cam ring on the first housing;

a second step of mounting a jig to the first housing and the cam ring which determines a position of the cam ring relative to the rotation shaft insertion hole of the first housing;

a third step of retreating the jig;

a fourth step of assembling the pump element and the rotation shaft into the cam ring; and a fifth step of placing the second housing on the cam ring on the side opposed to the first housing and fixing the first housing, the cam ring and the second housing to one another.

In a still further aspect of the invention, there is provided a method of assembling an oil pump, the oil pump including a first housing having a rotation shaft insertion hole, a cam ring disposed on the first housing, the cam ring having a generally cylindrical inner circumferential surface, a pump element that is rotatably disposed within the cam ring and performs suction and discharge of a working oil during rotation, a rotation shaft that rotatably extends through the rotation shaft insertion hole of the first housing and rotatively drives the pump element, and a second housing disposed on the cam ring on a side opposed to the first housing in an axial direction of the rotation shaft, the method comprising:

a first step of placing the cam ring on the first housing;

a second step of mounting a jig to the first housing and the cam ring which determines a position of the cam ring relative to the rotation shaft insertion hole of the first housing;

a third step of fixing the first housing and the cam ring to each other;

a fourth step of retreating the jig;

a fifth step of assembling the pump element and the rotation shaft into the cam ring; and a sixth step of placing the second housing on the cam ring on the side opposed to the first housing and fixing the first housing, the cam ring and the second housing to one another.

DETAILED DESCRIPTION OF THE INVENTION

Figure 1:
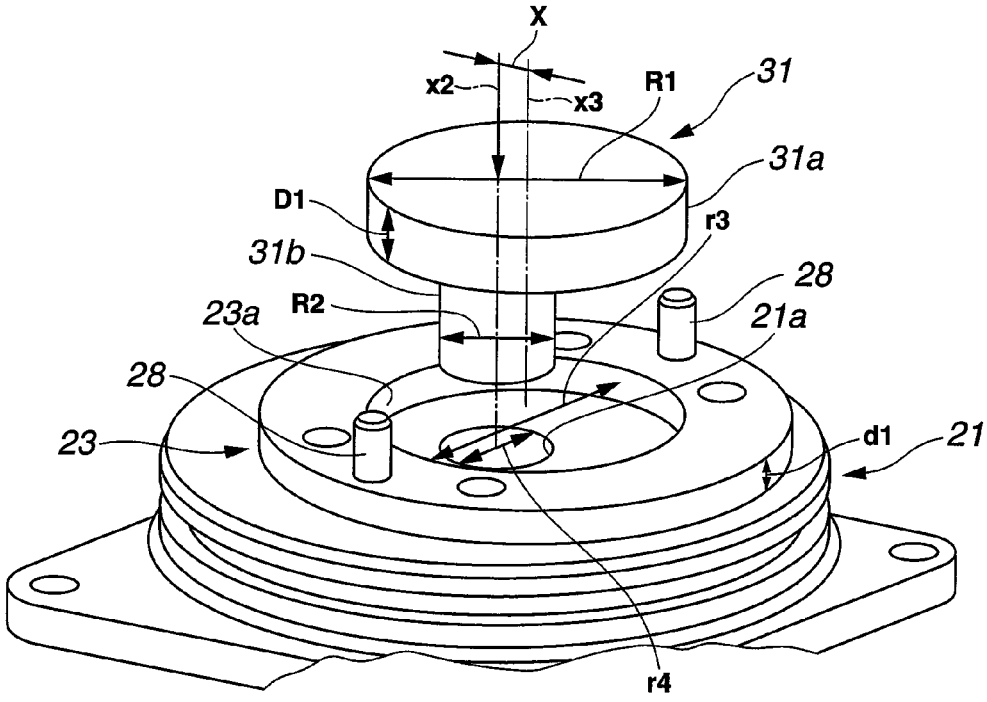
FIG. 1 is a perspective view of a pump housing and a cam ring of an oil pump and a jig of a first embodiment according to the present invention, and shows positioning of the cam ring using the jig.

Hereinafter, embodiments of an oil pump and a method for assembling the oil pump, according to the present invention, are explained in detail with reference to the drawings. In the embodiments, the oil pump is applied to a power steering apparatus for vehicles and is in the form of an internal gear pump. For ease of understanding, various directional terms, such as, upper, lower, right, left, upward, downward and the like as viewed in the drawings are used in the following description. However, such terms are to be understood with respect to only the drawings on which the corresponding parts or portions are shown.

Figure 4:
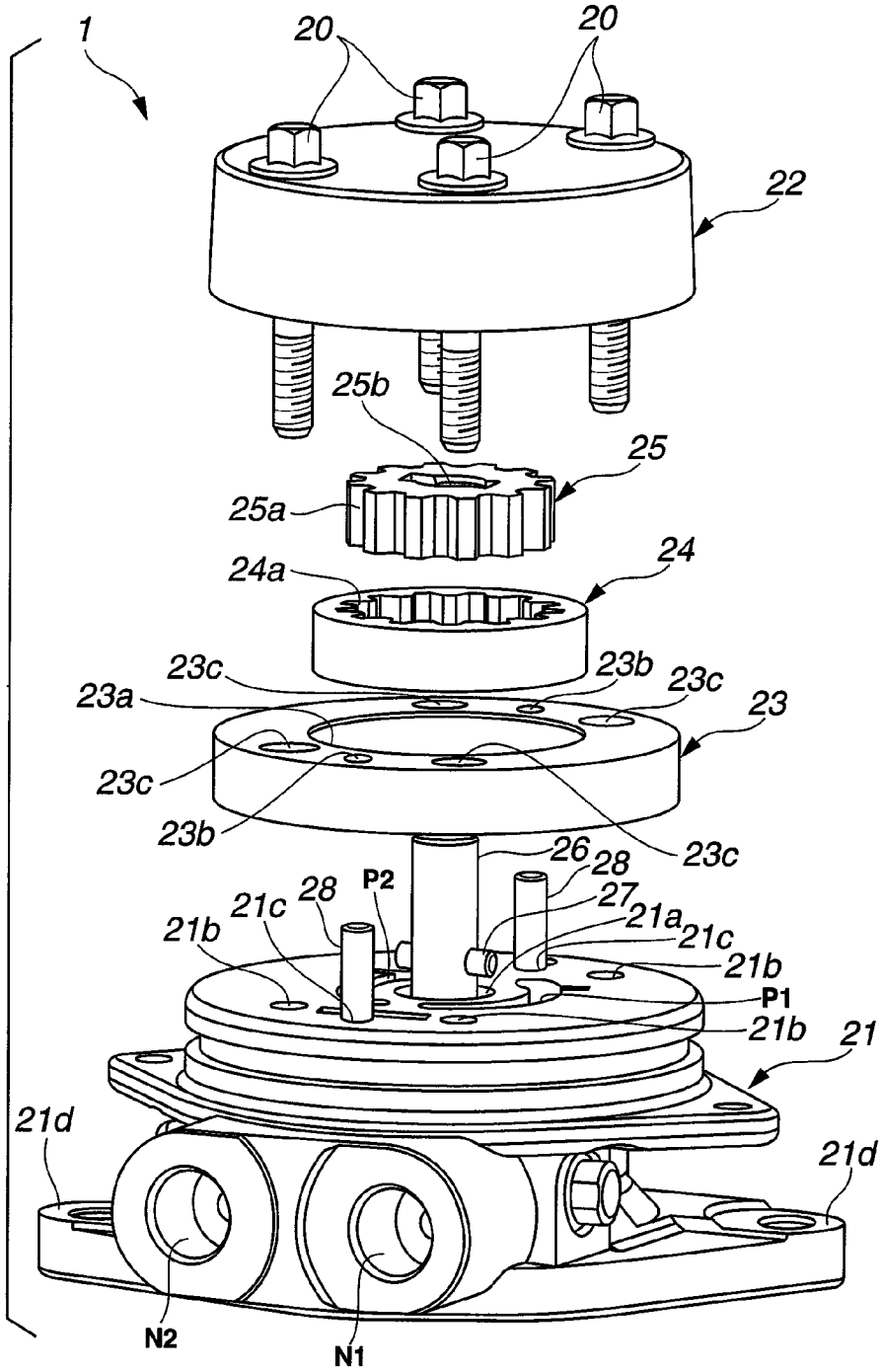
FIG. 4 is an exploded perspective view of the oil pump of the first embodiment.
Figure 5:
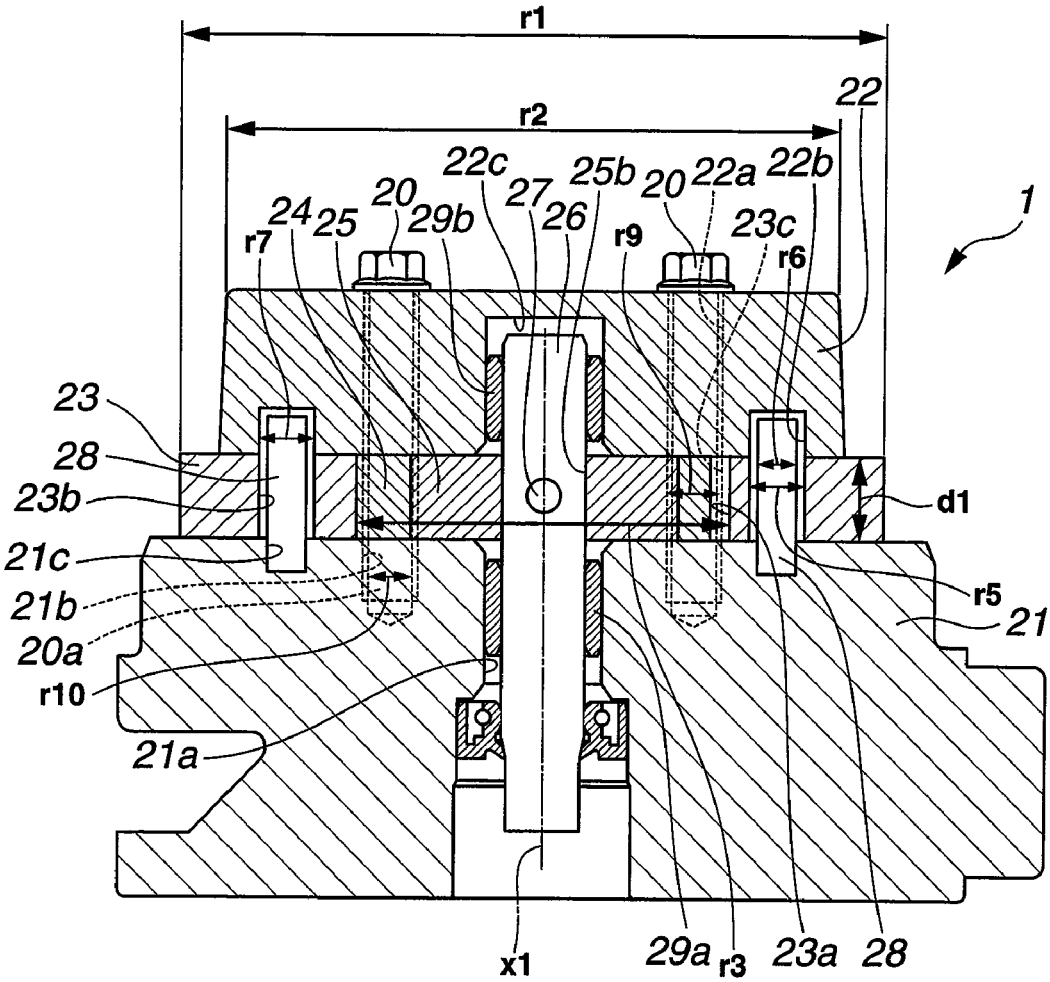
FIG. 5 is a cross section of the oil pump, taken along an axial direction of a rotation shaft of the oil pump of the first embodiment.
Figure 6:
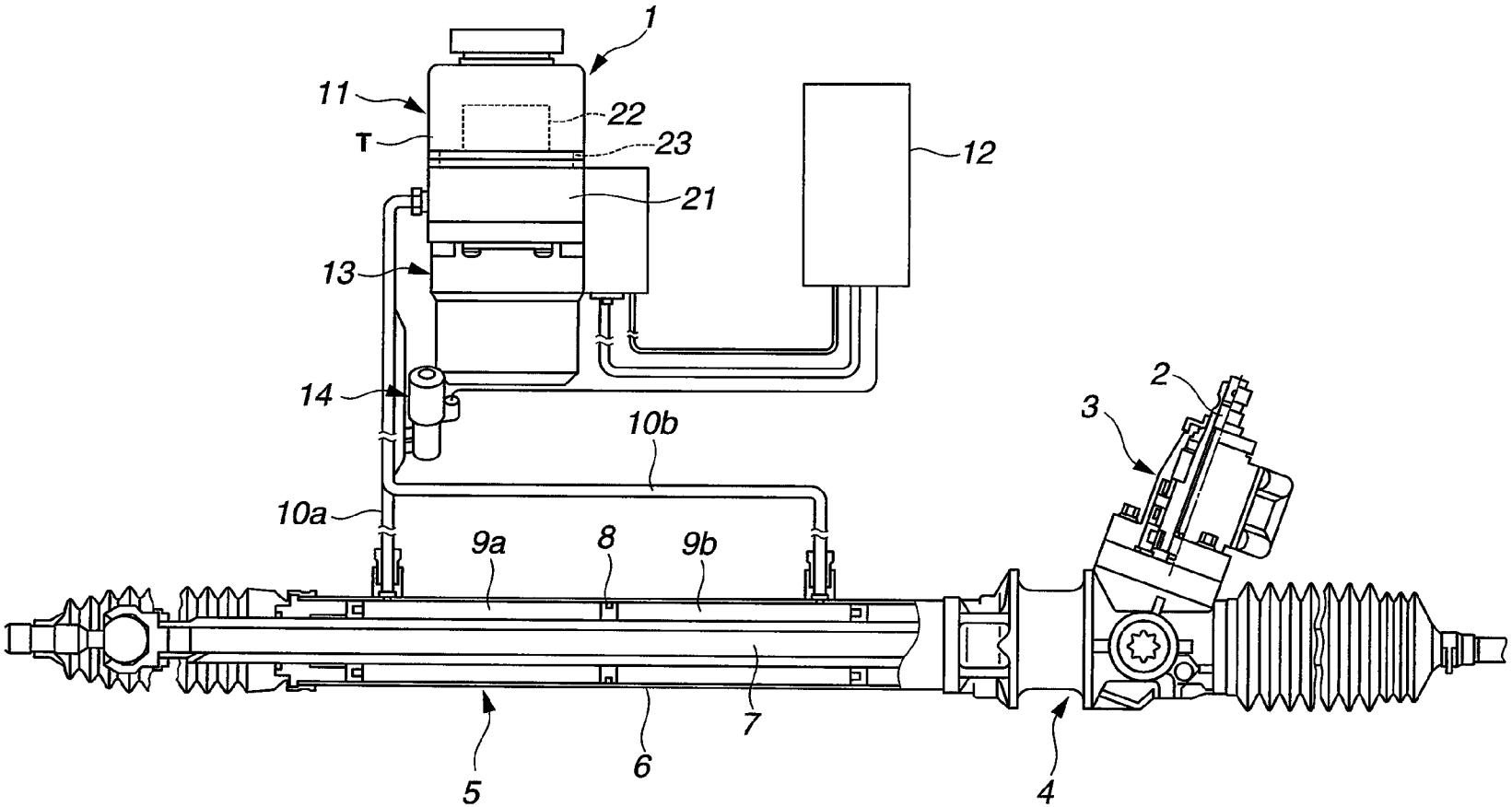
FIG. 6 is a schematic diagram showing a power steering apparatus for vehicles to which the first embodiment of the oil pump is applied.

FIG. 1 to FIG. 6 show a first embodiment of the present invention. As shown in FIG. 6, the power steering apparatus to which oil pump 1 of the first embodiment is applied includes steering shaft 2 that is connected with a steering wheel, not shown, torque sensor 3 for sensing a steering torque of steering shaft 2, rack and pinion mechanism 4 connected to steering shaft 2, power cylinder 5 connected to rack and pinion mechanism 4, and power unit 11 that supplies hydraulic pressure to power cylinder 5.

Power cylinder 5 includes cylinder tube 6 that extends in a width direction of the vehicle, and rack shaft 7 that extends through cylinder tube 6 and is connected to rack and pinion mechanism 4. Annular piston 8 is mounted to rack shaft 7 and slidably moveable within cylinder tube 6. Piston 8 divides an interior space of cylinder tube 6 into first hydraulic chamber 9*a* and second hydraulic chamber 9*b*.

Power unit 11 includes electronic controller 12 that controls vehicle conditions, electric motor 13 that is driven on the basis of control current inputted from electronic controller 12, and reversible oil pump 1 that is driven by electric motor 13. Oil pump 1 selectively performs supply of a hydraulic pressure to power cylinder 5 and discharge of the hydraulic pressure from power cylinder 5 via a pair of pipes 10*a* and 10*b*.

Fuel safe valve 14 is provided within both pipes 10*a* and 10*b* and performs supply and discharge of the hydraulic pressure in power cylinder 5 upon occurrence of failure in power unit 11.

Oil pump 1 is disposed above electric motor 13 and arranged to be vertically aligned and abut on electric motor 13 in the axial direction. Oil pump 1 cooperates with reservoir tank T to form a single unit.

As shown in FIG. 4 and FIG. 5, oil pump 1 includes pump body 21 as a first housing, cover member 22 as a second housing, rotation shaft 26 rotatably supported by pump body 21 and cover member 22, cam ring 23 interposed between pump body 21 and cover member 22, and outer and inner rotors 24 and 25 rotatably disposed on an inside of cam ring 23.

Pump body 21 is connected with an upper end portion of electric motor 13. Pump body 21 includes rotation shaft insertion hole 21*a* through which rotation shaft 26 extends. Rotation shaft insertion hole 21*a* extends through a central portion of pump body 21 and is disposed coaxially with rotation shaft 26. Cover member 22 is disposed on cam ring 23 on a side opposed to pump body 21 in the axial direction of rotation shaft 26. Cam ring 23 is formed into a generally annular shape and includes rotor receiving hole 23*a* which extends through a central portion of cam ring 23 in a direction parallel to axis x1 of rotation shaft 26. Pump body 21, cover member 22 and cam ring 23 are co-fastened by means of four bolts 20 as fastening members.

Outer rotor 24 and inner rotor 25 are disposed within rotor receiving hole 23*a* of cam ring 23 and cooperate with each other to act as a pump element. Outer rotor 24 is formed into a generally annular shape and has a plurality of inner teeth 24*a* on an inner circumferential surface thereof. Outer rotor 24 is fitted into rotor receiving hole 23*a* and slidable on a generally cylindrical-shaped inner circumferential surface of cam ring 23 which defines rotor receiving hole 23*a*. Inner rotor 25 is formed into a generally annular shape and has a plurality of outer teeth 25*a* on an outer circumferential surface thereof and central through-hole 25*b* on a central portion thereof. Inner rotor 25 is disposed on an inside of outer rotor 24 such that outer teeth 25*a* is engageable with inner teeth 24*a* of outer rotor 24. Rotation shaft 26 extends through rotation shaft insertion hole 21*a* and central through-hole 25*b* into cover member 22. Inner rotor 25 is fixedly supported on a side of one end portion of rotation shaft 26 by pin member 27.

Specifically, pump body 21 is formed into a generally cylindrical shape and has flange 21*d* at a lower end portion thereof as shown in FIG. 4. Pump body 21 is connected with electric motor 13 through flange 21*d*. Pump body 21 has crescent-shaped ports P1 and P2 on a planar upper end surface thereof. Ports P1 and P2 are spaced from each other in a circumferential direction of pump body 21 and arranged substantially symmetrically with respect to rotation shaft insertion hole 21*a* and corresponding to pump chambers which are formed between inner teeth 24*a* of outer rotor 24 and outer teeth 25*a* of inner rotor 25.

Pump body 21 has four tapped holes 21*b* on the upper end surface thereof which are arranged around rotation shaft insertion hole 21*a* in a substantially equidistantly spaced relation to each other in a circumferential direction of pump body 21. A pair of positioning holes 21*c*, 21*c* are disposed between predetermined adjacent two of four tapped holes 21*b* and substantially symmetrically arranged with respect to rotation shaft insertion hole 21*a*. A pair of positioning pins 28, 28 are inserted into positioning holes 21*c*, 21*c* and upwardly project from the upper end surface of pump body 21.

Further, pump body 21 has a pair of oil holes N1 and N2 on an outer circumferential surface thereof which are communicated with ports P1 and P2, respectively. Oil holes N1 and N2 also are connected with pipes 10*a* and 10*b* shown in FIG. 6, respectively.

Cover member 22 is formed into a generally cylindrical shape and has an internal oil passage therein. Cover member 22 is formed with four bolt mount holes 22*a* that extend through cover member 22. Bolt mount holes 22*a* are arranged corresponding to tapped holes 21*b* of pump body 21, into which bolts 20 are inserted. Cover member 22 has positioning recesses 22*b*, 22*b* on a lower end surface thereof which is opposed to the upper surface of cam ring 23 in the axial direction of rotation shaft 26. Positioning recesses 22*b*, 22*b* are formed corresponding to positioning pins 28, 28 that project form the upper end surface of pump body 21, and engaged with positioning pins 28, 28, respectively. Each of positioning recesses 22*b*, 22*b* has inner diameter r7 slightly larger than outer diameter r6 of each of positioning pins 28, 28. Cover member 22 further includes rotation shaft supporting hole 22*c* that is located corresponding to rotation shaft insertion hole 21*a* of pump body 21. Rotation shaft supporting hole 22*c* extends from the lower end surface of cover member 22 toward an upper end surface of cover member 22.

Rotation shaft 26 has axis x1 about which rotation shaft 26 is rotatable. Axis x1 of rotation shaft 26 is in alignment with central axis x2 of rotation shaft insertion hole 21*a* of pump body 21. Rotation shaft 26 is operated to rotate about axis x1 by a driving force that is produced by electric motor 13. Rotation shaft 26 rotatively drives inner and outer rotors 24 and 25, therefore acting as a driving shaft. Rotation shaft 26 is rotatably supported on one end portion thereof by means of bearing 29*b* that is disposed within rotation shaft supporting hole 22*c* of cover member 22. Rotation shaft 26 is also rotatably supported on a side of an opposite end thereof by means of bearing 29*a* that is disposed within rotation shaft insertion hole 21*a* of pump body 21.

Cam ring 23 has a radially outer contour at least a part of which projects radially outwardly from a radially outer contour of cover member 22. In this embodiment, as shown in FIG. 5, cam ring 23 has outer diameter r1 that is slightly larger than outer diameter r2 of cover member 22 and smaller than an outer diameter of the upper end surface of pump body 21. Cam ring 23 has axial thickness d1 that is substantially the same as an axial thickness of outer and inner rotors 24 and 25.

Rotor receiving hole 23*a* of cam ring 23 has inner diameter r3 slightly larger than an outer diameter of outer rotor 24. Cam ring 23 is arranged in a predetermined radial position, namely, an eccentric position relative to pump body 21 such that rotor receiving hole 23*a* is radially offset from rotation shaft insertion hole 21*a*. That is, central axis r3 of cam ring 23 is radially offset from central axis x2 of rotation shaft insertion hole 21*a* of pump body 21. Cam ring 23 is placed in the eccentric position relative to pump body 21 by using jig 31 as shown in FIG. 1. In this embodiment, eccentric amount x of central axis x3 of cam ring 23 relative to central axis x2 of rotation shaft insertion hole 21*a* is set to approximately 1.18 mm. Accordingly, outer rotor 24 within rotor receiving hole 23*a* is located in the eccentric state with respect to rotation shaft 26.

Referring back to FIG. 4 and FIG. 5, cam ring 23 is formed with two pin insertion holes 23*b*, 23*b* as through-holes which are located corresponding to positioning pins 28, 28 on the upper end surface of pump body 21. Positioning pins 28, 28 extend through pin insertion holes 23*b*, 23*b*, respectively. Each of pin insertion holes 23*b*, 23*b* has inner diameter r5 slightly larger than outer diameter r6 of each of positioning pins 28, 28, so that the positioning of cam ring 23 relative to pump body 21 can be readily performed.

Cam ring 23 further includes four bolt insertion holes 23*c* that are located corresponding to tapped holes 21*b* of pump body 21 in the eccentric position of cam ring 23. Each of bolt insertion holes 23*c* extends through cam ring 23 and has inner diameter r9 slightly larger than outer diameter r10 of threaded portion 20*a* of each of bolts 20. Cam ring 23 is secured to an upper end portion of pump body 21 together with cover member 22 through bolts 20 that extend into tapped holes 21*b* through bolt mount holes 22*a* and bolt insertion holes 23*c*.

An operation of thus-constructed oil pump 1 is explained by referring to FIG. 4 and FIG. 6. When rotation shaft 26 is driven to rotate inner rotor 25 fixed to rotation shaft 26, outer rotor 24 eccentrically arranged relative to rotation shaft 26 is rotated with respect to inner rotor 25. During the relative rotation of outer and inner rotors 24, 25, the pump chambers formed between inner teeth 24*a* and outer teeth 25*a* are changed in volumetric capacity. Owing to the change in volumetric capacity of the pump chambers, a working oil is continuously sucked into and discharged from oil pump 1 via ports P1, P2 and oil holes N1, N2. The working oil is supplied to and discharged from hydraulic chambers 9*a*, 9*b* of power cylinder 5 depending on the rotational direction of electric motor 13 that is drivingly controlled by electronic controller 12.

Next, referring to FIG. 1, jig 31 that determines a position, i.e., the above-described eccentric position, of cam ring 23 relative to rotation shaft insertion hole 21*a* of pump body 21 is explained. As shown in FIG. 1, jig 31 has a stepped cylindrical shape that is formed by two cylindrical portions 31*a* and 31*b* that are different in diameter from each other. Jig 31 includes large diameter portion 31*a* that is fitted into rotor receiving hole 23*a* of cam ring 23, and small diameter portion 31*b* that is fitted into rotation shaft insertion hole 21*a* of pump body 21. Large diameter portion 31*a* has outer diameter R1 and axial thickness D1 that is larger than axial thickness d1 of cam ring 23. Small diameter portion 31*b* has outer diameter R2 and a predetermined axial thickness.

Outer diameter R1 and outer diameter R2 are set such that large diameter portion 31*a* and small diameter portion 31*b* can establish a clearance fit to rotor receiving hole 23*a* and rotation shaft insertion hole 21*a*, respectively, without interference therebetween.

Jig 31 acts to place cam ring 23 in the above-described eccentric position relative to pump body 21 by fitting small diameter portion 31*b* into rotation shaft insertion hole 21*a* and fitting large diameter portion 31*a* into rotor receiving hole 23*a*. Jig 31 thus serves for performing positioning of cam ring 23 relative to pump body 21.

Outer rotor 24, inner rotor 25 and rotation shaft 26 cannot be assembled to pump body 21 while jig 31 is kept fitted to rotation shaft insertion hole 21*a* of pump body 21 and rotor receiving hole 23*a* of cam ring 23. Therefore, after performing the positioning of cam ring 23 by using jig 31, jig 31 is retreated from rotation shaft insertion hole 21*a* and rotor receiving hole 23*a* and then cam ring 23 is fixedly held in the eccentric position by cam ring holding device 32 until the assembling operation of oil pump 1 is completed.

Cam ring holding device 32 is disposed on a radial outside of pump body 21 and cam ring 23. Cam ring holding device 32 includes a pair of air cylinders 33, 33 and a pair of hold arms 34, 34 that are actuated by air cylinders 33, 33 to clamp cam ring 23. Air cylinders 33, 33 serving as actuators are disposed on an outside of cam ring 23 and pump body 21 in an opposed relation to each other in the radial direction of cam ring 23. Air cylinders 33, 33 are respectively mounted to supports, not shown. Air cylinders 33, 33 are not limited to a pneumatically operated type and may be of various other types such as a hydraulically, mechanically or electrically operated type. Air cylinders 33, 33 include piston rods 33*a*, 33*a* that downwardly extend from a lower axial end of air cylinders 33, 33 and are moveable in a vertical direction or an up-and-down direction in FIG. 3, namely, in a direction parallel to the axial direction of rotation shaft insertion hole 21*a* of pump body 21.

Hold arms 34, 34 extend from tip ends of piston rods 33*a*, 33*a* inwardly in a radial direction of cam ring 23, namely, in a radial direction of pump housing 21. Hold arms 34, 34 are spaced from and opposed to each other in the radial direction of cam ring 23. Hold arms 34, 34 are moveable together with piston rods 33*a*, 33*a* in the axial direction of piston rods 33*a*, 33*a*, namely, in the direction parallel to the axial direction of rotation shaft insertion hole 21*a* of pump body 21. That is, as piston rods 33*a*, 33*a* move in the axial direction thereof, hold arms 34, 34 move together with piston rods 33*a*, 33*a* in the same direction.

Figure 2:
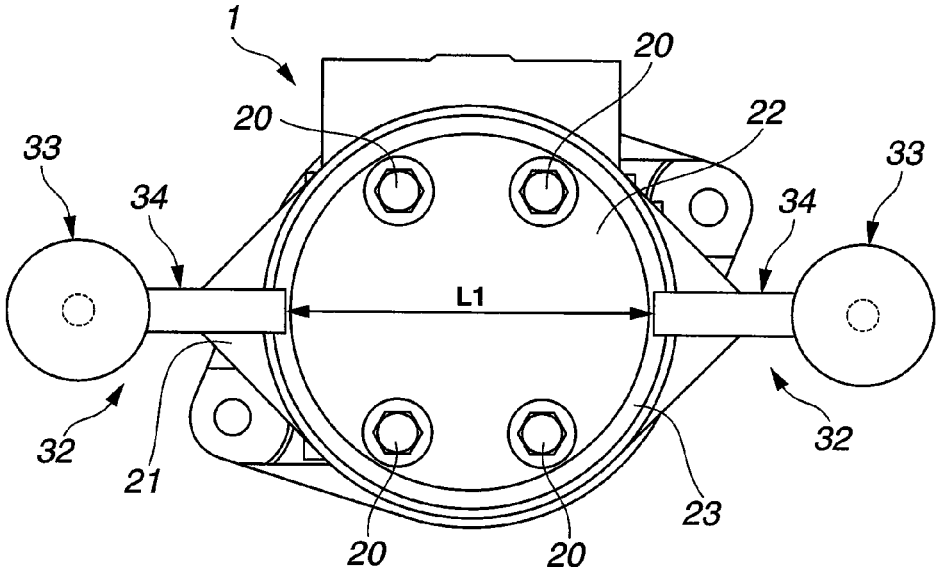
FIG. 2 is a plan view of the oil pump and a cam ring holding device of the first embodiment, and shows an operation of the cam ring holding device.
Figure 3:
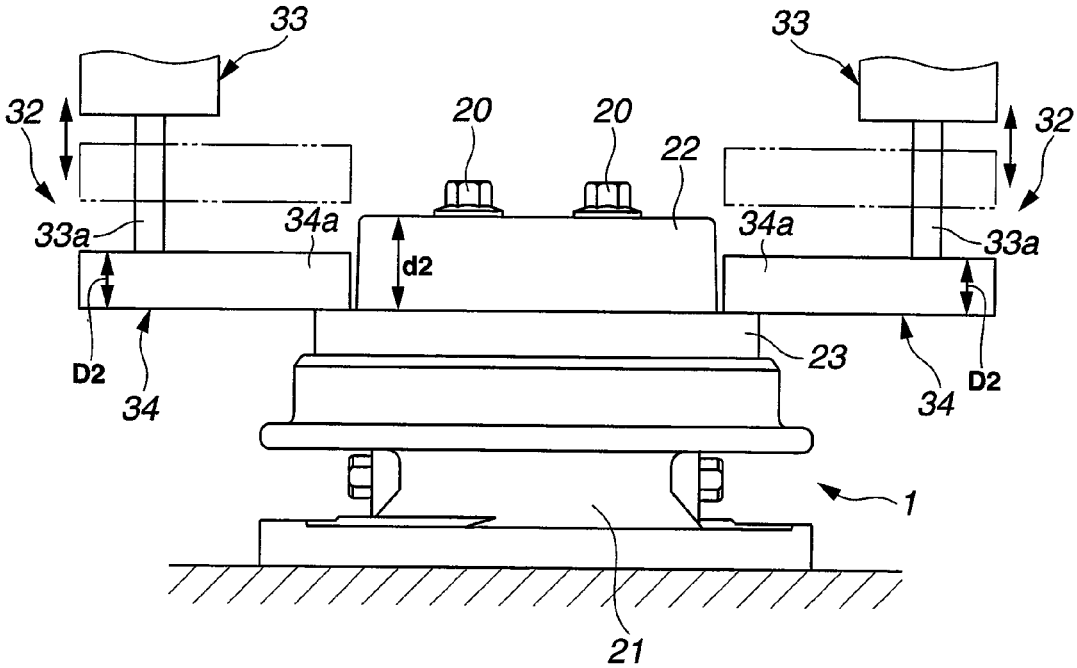
FIG. 3 is a front view of the oil pump and the cam ring holding device as shown in FIG. 2, and shows an operation of the cam ring holding device.

As shown in FIG. 3, hold arms 34, 34 are formed into a prism shape having a generally rectangular cross-section. Hold arms 34, 34 each have thickness D2 smaller than thickness d2 of cover member 22 in an axial direction of cover member 22. As seen from FIG. 2 and FIG. 5, distance L1 between opposed end surfaces of end portions 34*a*, 34*a* of hold arms 34, 34 is set slightly smaller than outer diameter r1 of cam ring 23 and larger than outer diameter r2 of cover member 22. Before being actuated, hold arms 34, 34 are placed upward of cam ring 23 as shown in FIG. 3.

After the positioning of cam ring 23 is performed by jig 31, hold arms 34, 34 are actuated to downwardly move to a predetermined position in the axial direction of piston rods 33*a*, 33*a*. In the predetermined position, lower surfaces of end portions 34*a*, 34*a* of hold arms 34, 34 are contacted with an outer circumferential periphery of the upper surface of cam ring 23 and hold arms 34, 34 downwardly press cam ring 23 onto the upper end surface of pump body 21. When pressing cam ring 23 onto pump body 21 by hold arms 34, 34, static friction force is caused between the outer circumferential periphery of the upper surface of cam ring 23 and the lower surfaces of end portions 34*a*, 34*a* of hold arms 34, 34. Cam ring 23 is fixed to pump body 21 in the eccentric position relative to pump body 21 by the static friction force.

A method for assembling oil pump 1 is explained hereinafter by referring to FIG. 1 to FIG. 5.

First, as shown in FIG. 4, positioning pins 28, 28 are inserted into positioning holes 21*c*, 21*c* of pump body 21 and thereby mounted to pump body 21. Subsequently, cam ring 23 is placed on the upper end surface of pump body 21 by engaging positioning pins 28, 28 in pin insertion holes 23*b*, 23*b* of cam ring 23 and moving cam ring 23 toward the upper end surface of pump body 21 along positioning pins 28, 28 as guides.

Next, as shown in FIG. 1, jig 31 is mounted to pump body 21 and cam ring 23 by fitting small diameter portion 31*b* into rotation shaft insertion hole 21*a* of pump body 21 and fitting large diameter portion 31*a* into rotor receiving hole 23*a* of cam ring 23. Cam ring 23 is slightly moved in the radial direction and placed in the predetermined radial position, i.e., the eccentric position relative to pump body 21, by rotating jig 31 while keeping jig 31 fitted into rotation shaft insertion hole 21*a* and rotor receiving hole 23*a*. Thus, the positioning of cam ring 23 relative to pump body 21 is performed.

Subsequently, as shown in FIG. 2 and FIG. 3, cam ring holding device 32 is actuated to move hold arms 34, 34 downwardly until the lower surface of end portions 34*a*, 34*a* of hold arms 34, 34 are contacted with the outer circumferential periphery of the upper surface of cam ring 23, while keeping jig 31 mounted to pump body 21 and cam ring 23. Hold arms 34, 34 then downwardly press and clamp cam ring 23 so that cam ring 23 is fixed to pump body 21 in the eccentric position.

Next, jig 31 is retreated from pump housing 21 and cam ring 23. Then, rotation shaft 26 and inner and outer rotors 25 and 24 are assembled into cam ring 23. Specifically, inner rotor 25 is previously assembled to rotation shaft 26 by being fixed to a side of an upper end of rotation shaft 26 when viewed in FIG. 5, through pin member 27. Rotation shaft 26 with inner rotor 25 pre-assembled to rotation shaft 26 is downwardly moved from an upper side of pump body 21, and a lower end portion of rotation shaft 26 is inserted into rotation shaft insertion hole 21*a* until inner rotor 25 is disposed within rotor receiving hole 23*a* of cam ring 23 and a lower surface of inner rotor 25 is contacted with the upper end surface of pump body 21. Then, outer rotor 24 is fitted into rotor receiving hole 23*a* of cam ring 23 while engaging inner teeth 24*a* of outer rotor 24 with outer teeth 25*a* of inner rotor 25.

Subsequently, cover member 22 is placed on the upper end surface of cam ring 23 on the side opposed to pump body 21 in the axial direction of rotation shaft 26, and pump body 21, cam ring 23 and cover member 22 are fixed to one another. Specifically, positioning recesses 22*b*, 22*b* of cover member 22 are engaged with positioning pins 28, 28, and cover member 22 is downwardly moved along positioning pins 28, 28 as guides. Then, cover member 22 and cam ring 23 are fixed to pump body 21 by co-fastening by means of bolts 20 that are screwed into bolt mount holes 22*a* and bolt insertion holes 23*c*.

Finally, hold arms 34, 34 are upwardly moved such that cam ring 23 is released from the clamped state. Thus, the assembling operation of oil pump 1 is completed.

The first embodiment has the following function and effect.

Since the radially outer contour of cam ring 23 is a generally circular shape in plan view, cam ring 23 can be easily formed. Further, since outer diameter r1 of cam ring 23 is larger than outer diameter r2 of cover member 22, a portion of cam ring 23 which projects radially outwardly from the radially outer contour of cover member 22 can be clamped by hold arms 34, 34 of cam ring holding device 32.

Further, since jig 31 is constructed as described above with high accuracy, the positioning of cam ring 23 in the predetermined radial position relative to pump body 21 can be readily performed using jig 31. Therefore, by only ensuring accuracy in inner diameter r3 of rotor receiving hole 23*a* of cam ring 23, occurrence of assembly error due to accumulative tolerance of the parts can be prevented. As a result, the positioning of cam ring 23 in the predetermined radial position relative to pump body 21 can be performed with high accuracy.

Further, after performing the positioning of cam ring 23 by using jig 31, cam ring 23 is fixed to pump body 21 by using cam ring holding device 32 until the assembly operation of oil pump 1 is completed. Therefore, when jig 31 is retreated after performing the positioning of cam ring 23 or even during the assembling operation subsequent to the retreating of jig 31, cam ring 23 can be prevented from being radially displaced from the predetermined radial position relative to pump body 21. The subsequent assembling operation of oil pump 1 can be carried out, while cam ring 23 is held in the predetermined radial position relative to pump body 21 by using cam ring holding device 32.

Since accuracy in positioning of cam ring 23 relative to pump housing 21 is thus ensured, out rotor 24 that is fitted to an inner circumferential side of cam ring 23 can be arranged in an eccentric relation to rotation shaft insertion hole 21*a* of pump body 21 with an appropriate amount of the eccentricity.

Further, inner rotor 25 is fixed to rotation shaft 26 that is supported in rotation shaft insertion hole 21*a* of pump body 21, and arranged in a coaxial relation to rotation shaft insertion hole 21*a*. Therefore, a gap (clearance) between inner teeth 24*a* of outer rotor 24 and outer teeth 25*a* of inner rotor 25 can be formed with enhanced accuracy.

Accordingly, in this embodiment, accuracy in forming the gap between inner teeth 24*a* of outer rotor 24 and outer teeth 25*a* of inner rotor 25 can be ensured by reducing influence of the assembly error of the parts which is caused due to accumulative tolerance of the parts such as pump body 21 and cam ring 23, to a minimum.

Further, increase in the number of parts of oil pump 1 can be prevented, and the construction of oil pump 1 can be simplified. Further, the accuracy in assembling oil pump 1 can be improved without necessity of enhancing the machining accuracy of parts. As a result, it is possible to obtain oil pump 1 having a stable discharge characteristic without increase in the production costs.

Further, since cam ring 23 is fixed to pump body 21 in the predetermined radial position by cam ring holding device 32 after completing the positioning of cam ring 23, it is not necessary to use other fixing members for fixing cam ring 23 to pump body 21 before coupling cam ring 23 and cover member 22 to pump body 21. Therefore, the operation of assembling cam ring 23 to pump body 21 can be readily performed and can be prevented from being complicated due to such an operation of fixing cam ring 23 to pump body 21 using the other fixing members after performing the positioning of cam ring 23.

Furthermore, owing to the construction that outer diameter r1 of cam ring 23 is slightly larger than outer diameter r2 of cover member 22, the difference between outer diameters r1 and r2 can be used as an allowance for clamping cam ring 23 by hold arms 34, 34. Thus, the allowance can be ensured without additional machining of cam ring 23 for providing cam ring 23 with the allowance. Therefore, the operation for fixing cam ring 23 to pump body 21 after performing the positioning of cam ring 23 can be readily performed, and it is possible to suppress increase in the number of machining processes of cam ring 23 that would be caused due to the additional machining for the allowance. Further, outer diameter r1 of cam ring 23 may be suitably varied in view of balance between the clamping performance of cam ring holding device 32 and the weight of cam ring 23.

Figure 7:
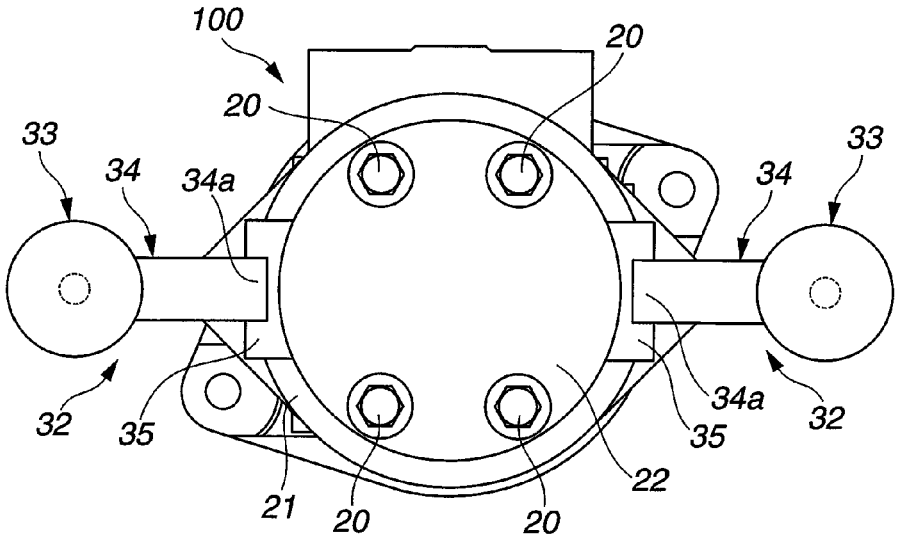
FIG. 7 is a view similar to FIG. 2, but shows a second embodiment of the present invention.
Figure 8:
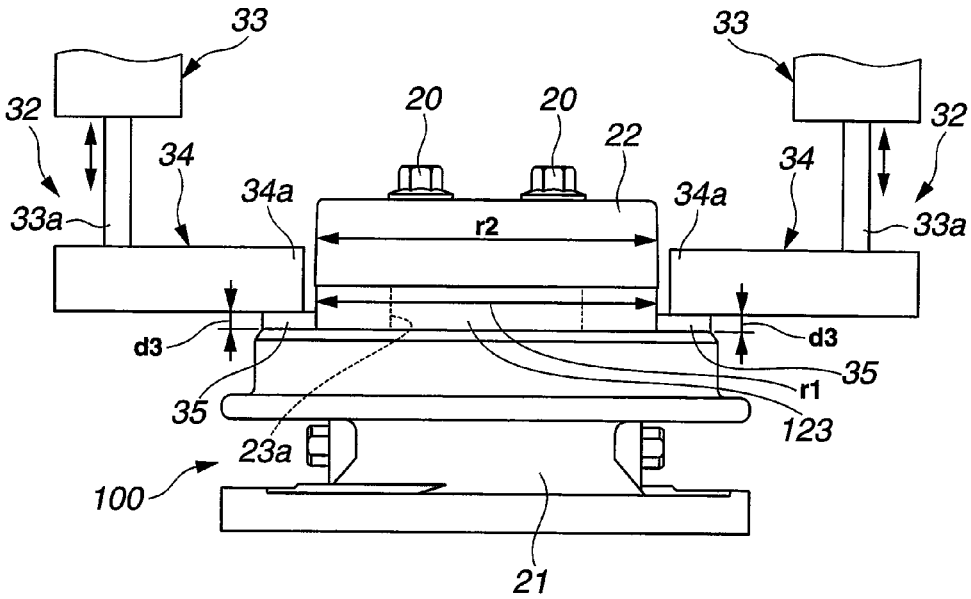
FIG. 8 is a view similar to FIG. 3, but shows the second embodiment of the present invention.

Referring to FIG. 7 and FIG. 8, there is shown a second embodiment in which cam ring 123 differs in construction from cam ring 23 of the first embodiment. Like reference numerals denote like parts, and therefore, detailed descriptions therefor are omitted. In the second embodiment, cam ring 123 includes projections 35, 35 as a part of a radially outer contour of cam ring 123 which projects radially outwardly from a radially outer contour of cover member 22.

As illustrated in FIG. 8, outer diameter r1 of cam ring 123 is substantially equal to outer diameter r2 of cover member 22. Cam ring 123 includes a pair of projections 35, 35 that project from an outer circumferential periphery of cam ring 123 in the radial direction of cam ring 123. Projections 35, 35 serve as clamped portions that are clamped by cam ring holding device 32. Projections 35, 35 are formed in predetermined positions in the circumferential direction of cam ring 123. When viewed in FIG. 7, projections 35, 35 project from an outer circumferential periphery of cover member 22 in a radial direction of cover member 22.

Projections 35, 35 are formed into a generally rectangular shape in cross-section and are symmetrically arranged with respect to rotor receiving hole 23*a* of cam ring 123 as shown in FIG. 7. Projections 35, 35 have an amount of projection which is designed to be not larger than a distance between radially opposed outer peripheral portions of the upper end surface of pump body 21 with which projections 35, 35 are contacted, respectively. In other words, the amount of projection of projections 35, 35 is adjusted such that projections 35, 35 are prevented from radially outwardly projecting from the outer peripheral portions of the upper end surface of pump body 21. Projections 35, 35 have thickness d3 shown in FIG. 8 which is remarkably smaller than thickness d1 of cam ring 123.

After the positioning of cam ring 123 is performed using jig 31 in the same manner as described in the first embodiment, the fixing operation using cam ring holding device 32 is performed. Hold arms 34, 34 are actuated to downwardly move and clamp projections 35, 35 of cam ring 123 on pump body 21. Thus, cam ring 123 is fixed to pump body 21 in the predetermined radial position relative to pump body 21. The subsequent assembling operation of oil pump 100 is performed in the same manner as described in the first embodiment.

Accordingly, the second embodiment can perform the same function and effect as those of the first embodiment. Further, with the provision of projections 35, 35, it becomes unnecessary to increase the size of cam ring 123 as a whole for the sake of the fixing operation using cam ring holding device 32. This serves for downsizing cam ring 123 and reducing increase in weight of cam ring 123.

Figure 9:
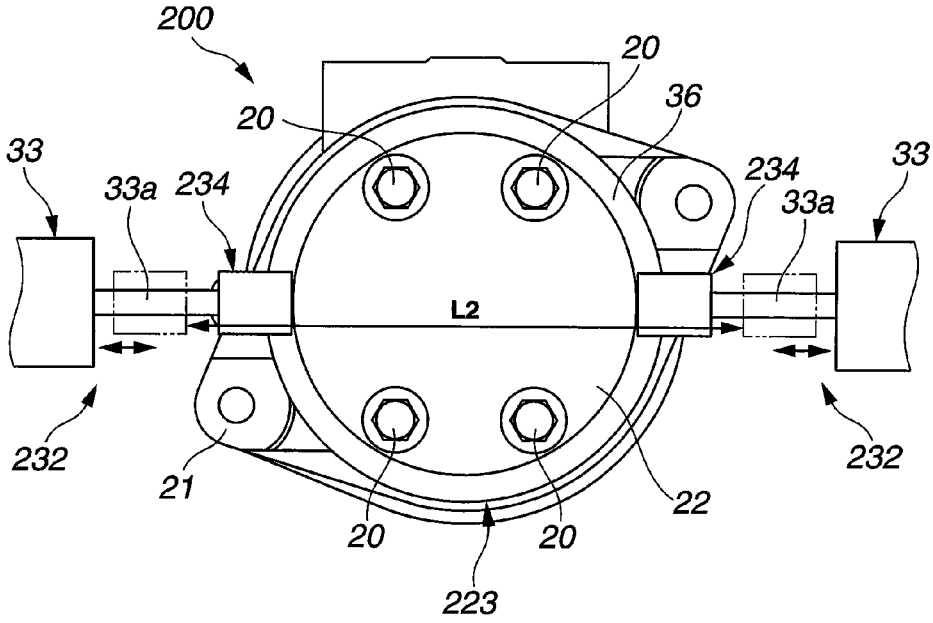
FIG. 9 is a view similar to FIG. 2, but shows a third embodiment of the present invention.
Figure 10:
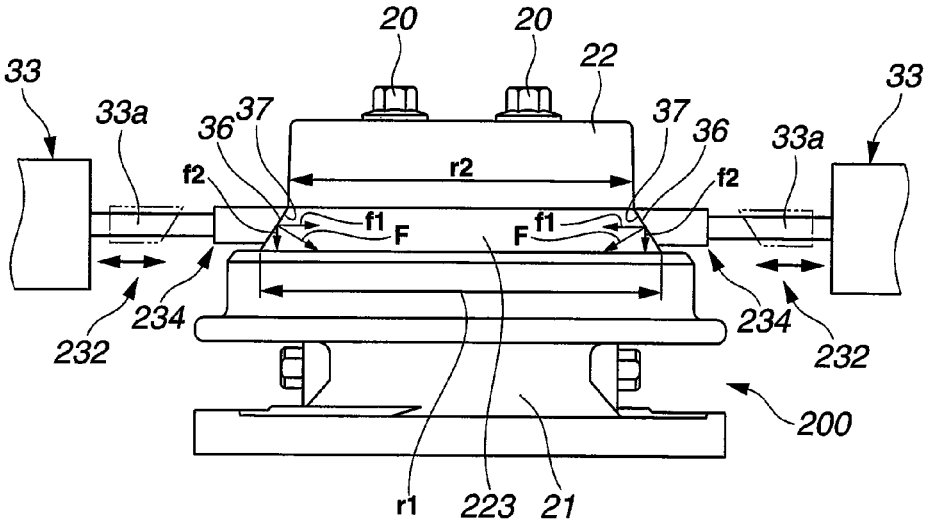
FIG. 10 is a view similar to FIG. 3, but shows the third embodiment of the present invention.

Referring to FIG. 9 and FIG. 10, there is shown a third embodiment in which cam ring 223 and cam ring holding device 232 differs from cam ring 23 and cam ring holding device 32 of the first embodiment in that cam ring 223 includes tapered circumferential surface 36 having a maximum outer diameter larger than the radially outer contour of cover member 22. As illustrated in FIG. 10, tapered circumferential surface 36 is tapered such that outer diameter r1 of cam ring 223 is gradually decreased from a side of pump body 21 toward a side of cover member 22. That is, tapered circumferential surface 36 is inclined with respect to the axis of cam ring 223. Specifically, cam ring 223 has outer diameter r1 at a lower end periphery thereof which is smaller than an outer diameter of the upper end surface of pump body 21. Cam ring 223 also has an outer diameter at an upper end periphery thereof which is smaller than outer diameter r1 of the lower end periphery and substantially equal to outer diameter r2 of cover member 22. Tapered circumferential surface 36 extends from the lower end periphery of cam ring 223 to the upper end periphery thereof.

Cam ring holding device 232 is constructed to be of a radially moveable type unlike cam ring holding device 32 of the first embodiment which is of the vertically moveable type. Cam ring holding device 232 includes air cylinders 33, 33 that are disposed on an outside of cam ring 223 and spaced from and opposed to each other in a direction substantially parallel to the upper end surface of pump body 21. Piston rods 33*a*, 33*a* extend from axial ends of air cylinders 33, 33 toward the outer circumferential surface of cam ring 223 and are moveable in the radial direction of cam ring 223, namely, in a direction perpendicular to the axial direction of rotation shaft insertion hole 21*a* of pump body 21.

Hold arms 234, 234 extend from tip ends of piston rods 33*a*, 33*a* in the radial direction of cam ring 223. Hold arms 234, 234 are spaced from and opposed to each other in the radial direction of cam ring 223 and moveable in the radial direction of cam ring 223. As piston rods 33*a*, 33*a* move in the radial direction of cam ring 223, hold arms 234, 234 move together with piston rods 33*a*, 33*a* in the same direction and clamp and release tapered circumferential surface 36 of cam ring 223.

Hold arms 234, 234 are formed into a prism shape having a generally rectangular cross-section. Hold arms 234, 234 have tapered contact surfaces 37, 37 on tip ends thereof, respectively, which are configured to be engageable with tapered circumferential surface 36 of cam ring 223. Further, as shown in FIG. 9, when piston rods 33*a*, 33*a* are placed in a most-retreated position relative to cam ring 223, distance L2 between opposed end portions of hold arms 234, 234 is slightly larger than the outer diameter of pump body 21.

In the third embodiment, oil pump 200 is assembled by the same method as described in the first embodiment except for the fixing operation using cam ring holding device 232.

Specifically, after performing the positioning of cam ring 223 relative to pump body 21 by using jig 31, hold arms 234, 234 of cam ring holding device 232 are advanced toward cam ring 223 until tapered contact surfaces 37, 37 come into engagement with tapered circumferential surface 36 of cam ring 223. Hold arms 234, 234 then clamp cam ring 223 by tapered contact surfaces 37, 37 from both outsides of cam ring 223. In this state, as shown in FIG. 10, pressing force F is exerted on tapered circumferential surface 36 of cam ring 223 in a direction perpendicular to tapered circumferential surface 36.

Pressing force F is decomposed into force f1 that acts on cam ring 223 inwardly in the radial direction of cam ring 223 and force f2 that acts on cam ring 223 downwardly in the axial direction of cam ring 223. Therefore, cam ring 223 is supported by force f1 and pressed onto pump body 21 by force f2. Thus, cam ring 223 is held in the predetermined radial position relative to pump body 21 by forces f1 and f2 that are applied to cam ring 223 through tapered circumferential surface 36 by hold arms 234, 234.

In the third embodiment, cam ring 223 is pressed by force f1 that radially inwardly acts on cam ring 223 and force 2 that axially downwardly acts on cam ring 223 owing to the engagement between tapered circumferential surface 36 and tapered contact surfaces 37, 37. Accordingly, as compared to a case where cam ring 223 is pressed downwardly only, a restraint force that acts on cam ring 223 in the radial direction of cam ring 223 can be enhanced. As a result, the fixing operation for holding cam ring 223 in the predetermined radial position can be more effectively performed.

Further, with the provision of tapered circumferential surface 36 on cam ring 223 and tapered contact surfaces 37, 37 on hold arms 234, 234 which are engageable with tapered circumferential surface 36, cam ring 223 can be also fixed to pump body 21 in the radial direction by cam ring holding device 232. Therefore, cam ring 223 can be effectively fixed to pump body 21. Further, cam ring 223 is clamped by hold arms 234, 234 of cam ring holding device 232 from opposite radial outsides of cam ring 223, cam ring 223 can be stably fixed to pump body 21 regardless of a dimension, namely, outer diameter r1, of cam ring 223. Accordingly, displacement of cam ring 223 in the radial direction can be restrained without increasing a size of cam ring 223.

Figure 11:
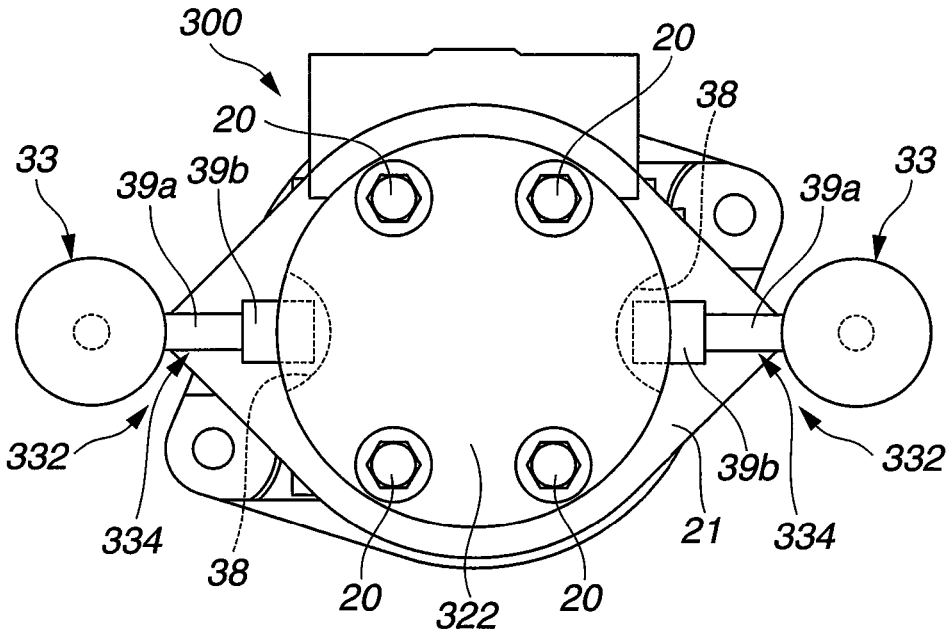
FIG. 11 is a view similar to FIG. 2, but shows a fourth embodiment of the present invention.
Figure 12:
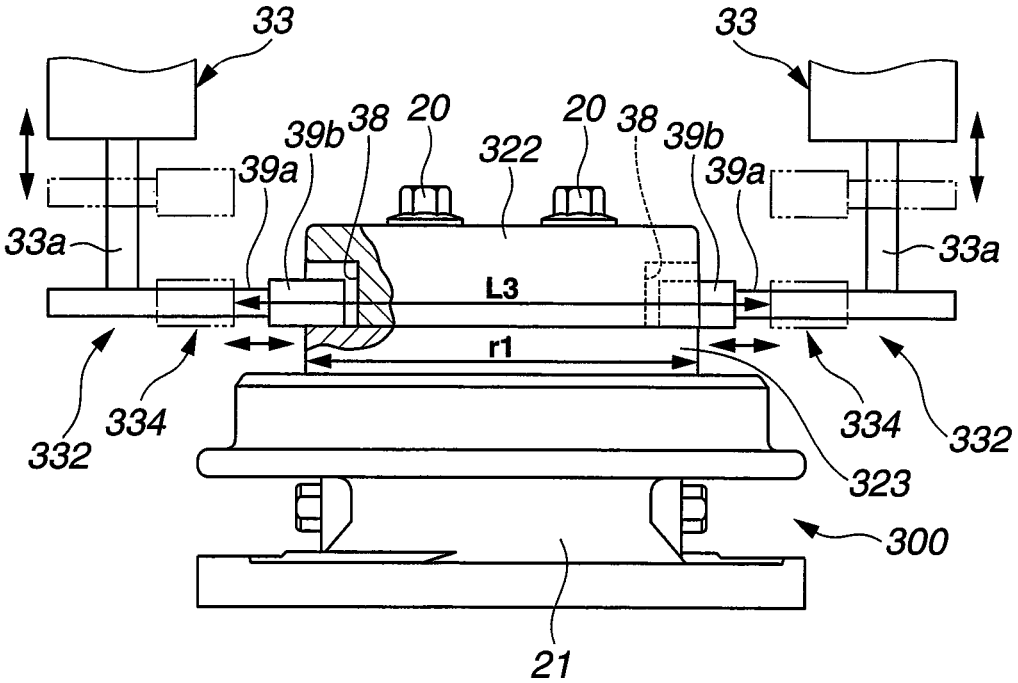
FIG. 12 is a view similar to FIG. 3, but shows the fourth embodiment of the present invention.

Referring to FIG. 11 and FIG. 12, there is shown a fourth embodiment which differs from the first embodiment in construction of cover member 322, cam ring 323 and cam ring holding device 332. As illustrated in FIG. 11 and FIG. 12, cover member 322 includes a pair of recessed portions 38, 38 that are formed at an outer circumferential periphery of cover member 322 and open to the lower end surface of cover member 322 which overlaps with cam ring 323. Specifically, recessed portions 38, 38 are arranged in predetermined positions at the outer circumferential periphery of cover member 322. Recessed portions 38, 38 are arranged symmetrically with respect to the axial direction of cover member 322, namely, in a diametrically opposed relation to each other. Recessed portions 38, 38 are radially inwardly recessed from an outer circumferential surface of cover member 322 and extend in an axial direction of cover member 322 to be open to the lower end surface of cover member 322. Cam ring 323 has outer diameter r1 that is substantially equal to outer diameter r2 of cover member 322. Cover member 322 has a diameter at a radial inside periphery of recessed portions 38, 38 which is smaller than an outer diameter of the upper surface of cam ring 323.

Hold arms 334, 334 of cam ring holding device 332 include bases 39*a*, 39*a* that are connected with tip ends of piston rods 33*a*, 33*a*, and hollow slides 39*b*, 39*b* that are fitted to end portions of bases 39*a*, 39*a*. Bases 39*a*, 39*a* are formed into a prism shape having a generally rectangular cross-section. Slides 39*b*, 39*b* are moveable in the radial direction of cam ring 323 so as to slidably enter into recessed portions 38, 38 of cover member 322. Further, as shown in FIG. 12, when slides 39*b*, 39*b* are placed in a most-retreated position relative to cam ring 323, distance L3 between opposed end surfaces of slides 39*b*, 39*b* is larger than outer diameter r1 of cam ring 323.

In the fourth embodiment, oil pump 300 is assembled in the same manner as that in the first embodiment except for the fixing operation using cam ring holding device 332 and the retreating operation of cam ring holding device 332.

The fixing operation using cam ring holding device 332 is explained. After performing the positioning of cam ring 323 relative to pump body 21 by using jig 31, slides 39*b*, 39*b* of hold arms 334, 334 are advanced in the radially inward direction of cam ring 323. Subsequently, hold arms 334, 334 are downwardly moved such that slides 39*b*, 39*b* are opposed to recessed portions 38, 38 of cover member 322. Slides 39*b*, 39*b* then are entered into recessed portions 38, 38. Hold arms 334, 334 are downwardly moved until lower surfaces of slides 39*b*, 39*b* are contacted with the outer circumferential periphery of the upper surface of cam ring 323. Hold arms 334, 334 then clamp cam ring 323 by slides 39*b*, 39*b* so that cam ring 323 is fixed to pump body 21 in the predetermined radial position relative to pump body 21.

The retreating operation of cam ring holding device 332 is carried out as follows. After cover member 322 and cam ring 323 are co-fastened to pump body 21 by means of bolts 20, hold arms 334, 334 are moved slightly upwardly to thereby interrupt the contact between slides 39*b*, 39*b* and cam ring 323. Slides 39*b*, 39*b* are then retreated from recessed portions 38, 38 to the most-retreated position. Subsequently, hold arms 334, 334 are upwardly moved so that the retreating operation of cam ring holding device 332 is ended. The assembling operation of oil pump 300 is thus completed.

In the fourth embodiment, with the provision of recessed portions 38, 38 in cover member 322, slides 39*b*, 39*b* of hold arms 334, 334 are received in recessed portions 38, 38. Therefore, even in a case where outer diameter r1 of cam ring 323 is substantially equal to or smaller than outer diameter r2 of cover member 322, cover member 22 can be assembled to pump body 21 while cam ring 323 is kept in the fixed state relative to pump body 21 by hold arms 334, 334. This serves for downsizing cam ring 323 in the radial direction.

Figure 13:
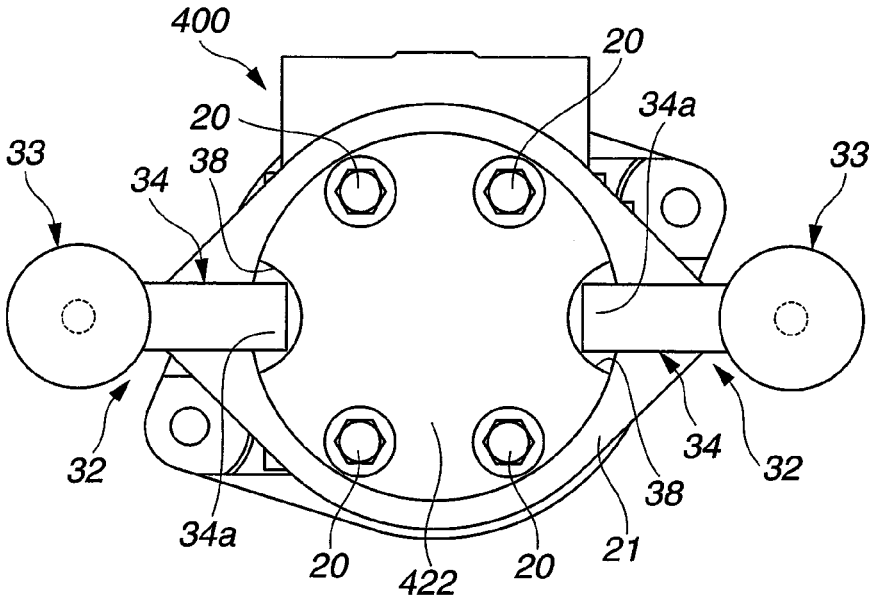
FIG. 13 is a view similar to FIG. 2, but shows a fifth embodiment of the present invention.
Figure 14:
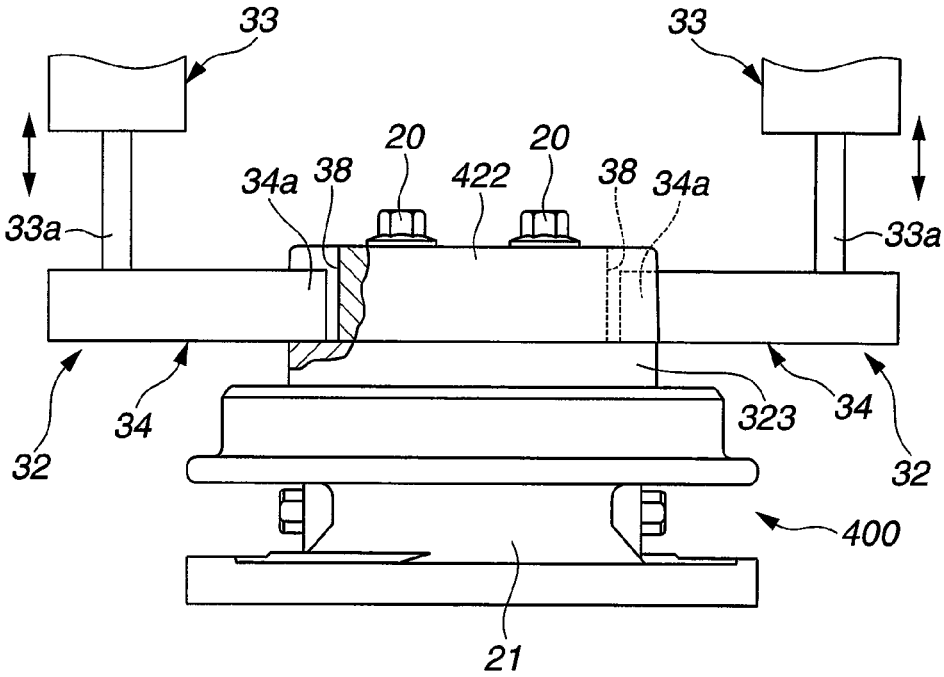
FIG. 14 is a view similar to FIG. 3, but shows the fifth embodiment of the present invention.

Referring to FIG. 13 and FIG. 14, there is shown a fifth embodiment which differs from the fourth embodiment in construction of recessed portions 38, 38 of cover member 422. As illustrated in FIG. 13 and FIG. 14, recessed portions 38, 38 extend through an entire axial length, i.e., thickness of cover member 422 in the axial direction of cover member 422, namely, parallel to the axial direction of rotation shaft 26. Recessed portions 38, 38 are open to an upper end surface of cover member 422. Cam ring holding device 32 is the same as that of the first embodiment. The assembling operation of oil pump 400 is performed by substantially the same method as described in the first embodiment.

The fifth embodiment can attain the same effect as that of the fourth embodiment. In addition, in the fifth embodiment, with the provision of recessed portions 38, 38 extending through the entire axial length of cover member 422, cam ring 323 can be brought into the fixed state and released from the fixed state by simply moving hold arms 34, 34 in the axial direction of cam ring 323, namely, in the up-and-down direction in FIG. 14. Therefore, the releasing operation for releasing cam ring 323 from the fixed state and the retreating operation for retreating hold arms 34, 34 from cam ring 323 can be simultaneously performed by moving hold arms 34, 34 upwardly. Also, the advancing operation for advancing hold arms 34, 34 toward cam ring 323 and the fixing operation for fixing cam ring 323 to pump body 21 can be simultaneously performed by moving hold arms 34, 34 downwardly. Thus, unlike hold arms 334, 334 of the fourth embodiment, it is not necessary to move hold arms 34, 34 in the radial direction of cam ring 323. Accordingly, the moving operation of hold arms 34, 34 can be simply and readily performed, resulting in increasing efficiency in the assembling operation of oil pump 400.

Figure 15:
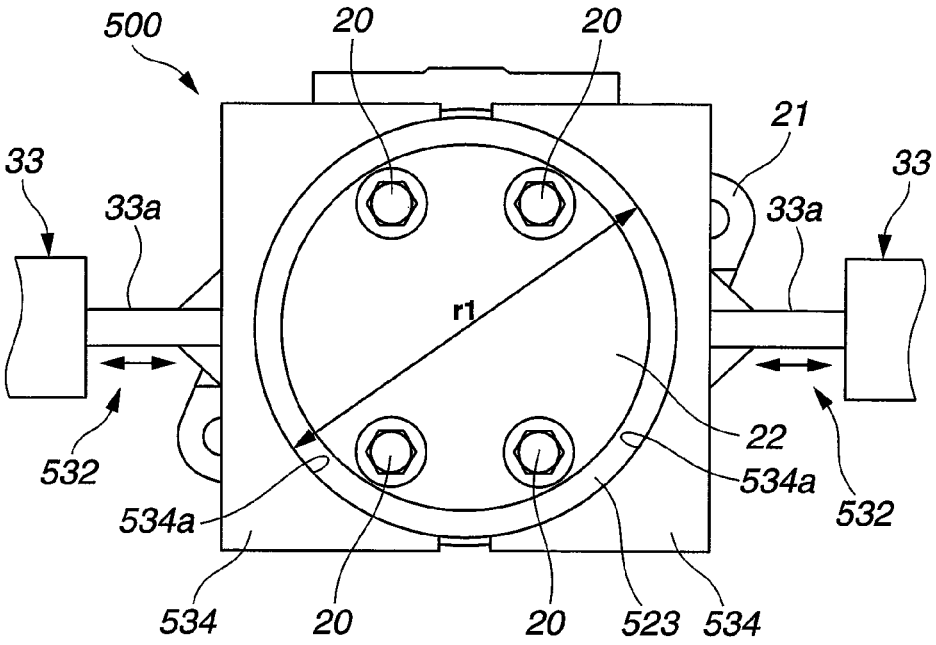
FIG. 15 is a view similar to FIG. 2, but shows a sixth embodiment of the present invention.
Figure 16:
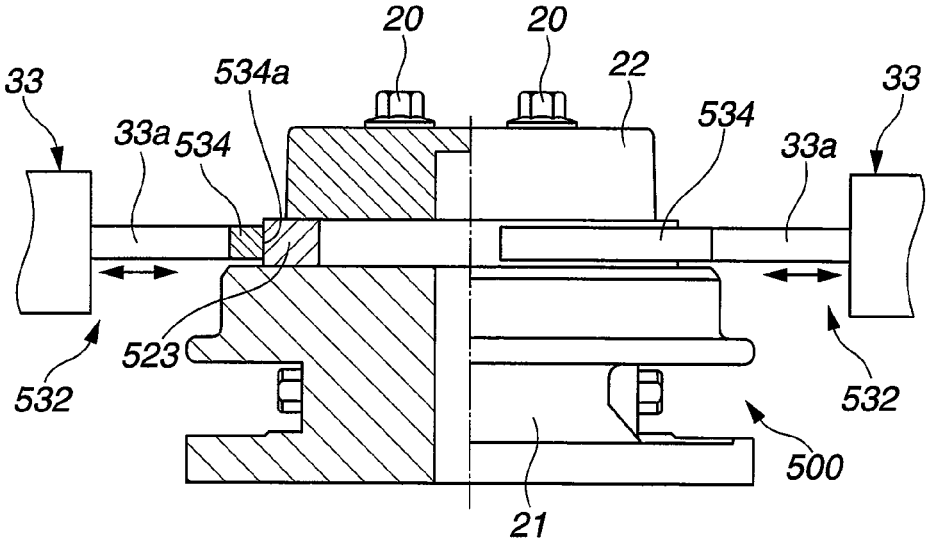
FIG. 16 is a view similar to FIG. 3, but shows the sixth embodiment of the present invention.

Referring to FIG. 15 and FIG. 16, there is shown a sixth embodiment which differs from the third embodiment in construction of cam ring 523 and hold arms 534, 534 of cam ring holding device 532. As illustrated in FIG. 16, cam ring 523 has a cylindrical outer circumferential surface that extends in the axial direction of cam ring 523 without being tapered. Further, as illustrated in FIG. 15, hold arms 534, 534 of cam ring holding device 532 are formed into a plate shape and have a width larger than outer diameter r1 of cam ring 523 which extends perpendicular to the axial direction of cam ring 532 and the axial direction of piston rods 33*a*. Hold arms 534, 534 have contact surfaces on tip end portions 534*a*, 534*a* which cooperate with each other to be engageable with a substantially entire area of the outer circumferential surface of cam ring 523. The contact surfaces of hold arms 534, 534 are configured corresponding to the cylindrical shape of the outer circumferential surface of cam ring 523. That is, the contact surfaces of hold arms 534, 534 are respectively concaved surfaces that have an arcuate shape as shown in FIG. 15.

The assembling operation of oil pump 500 is performed similar to that of the third embodiment. After performing the positioning of cam ring 523 by using jig-31, hold arms 534, 534 are advanced toward cam ring 523 until the contact surfaces of hold arms 534, 534 come into engagement with the outer circumferential surface of cam ring 523. Hold arms 534, 534 then clamp cam ring 523 by the contact surfaces in the radially inward direction of cam ring 523 from both outsides of cam ring 523. In this state, cam ring 523 is restrained from being displaced in the radial direction thereof and fixed to pump body 21 in the predetermined radial position relative to pump body 21.

The sixth embodiment can attain the same function and effect of those of the third embodiment. In addition, since the contact surfaces of hold arms 534, 534 of cam ring holding device 532 are configured corresponding to the cylindrical shape of the outer circumferential surface of cam ring 523, cam ring 523 can be effectively prevented from being displaced in the radial direction. Further, cam ring 523 is fixed to pump body 21 in the predetermined radial position relative to pump body 21 by clamping cam ring 523 in the radially inward direction from both outsides of cam ring 523 and by engaging the contact surfaces of hold arms 534, 534 with the substantially entire area of the outer circumferential surface of cam ring 523. Accordingly, cam ring 523 can be more effectively prevented from being displaced in the radial direction and thereby can be stably held in the predetermined radial position relative to pump body 21 in the fixed state.

Figure 17:
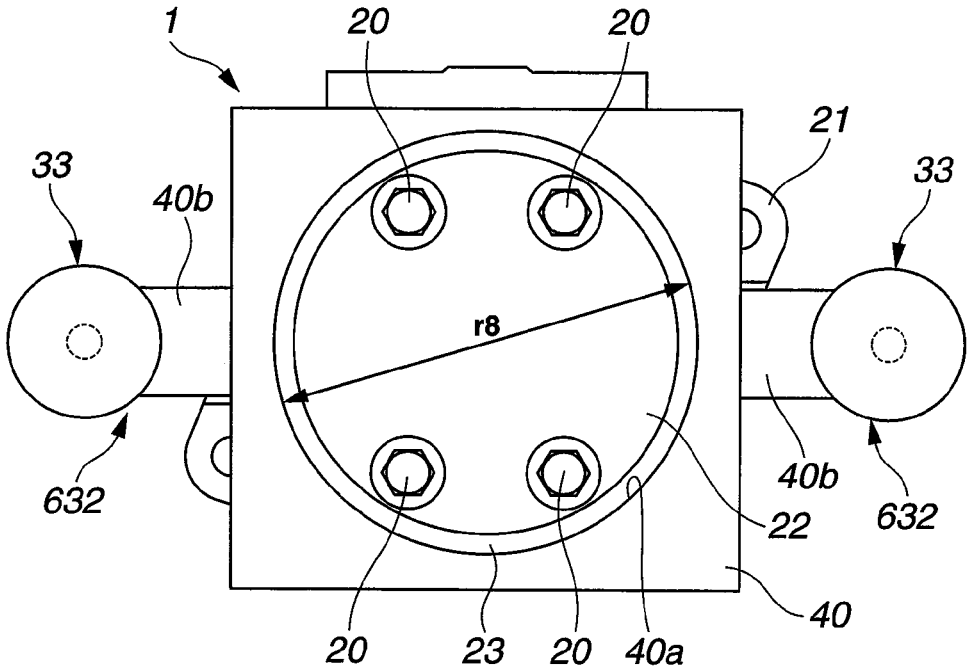
FIG. 17 is a view similar to FIG. 2, but shows a seventh embodiment of the present invention.
Figure 18:
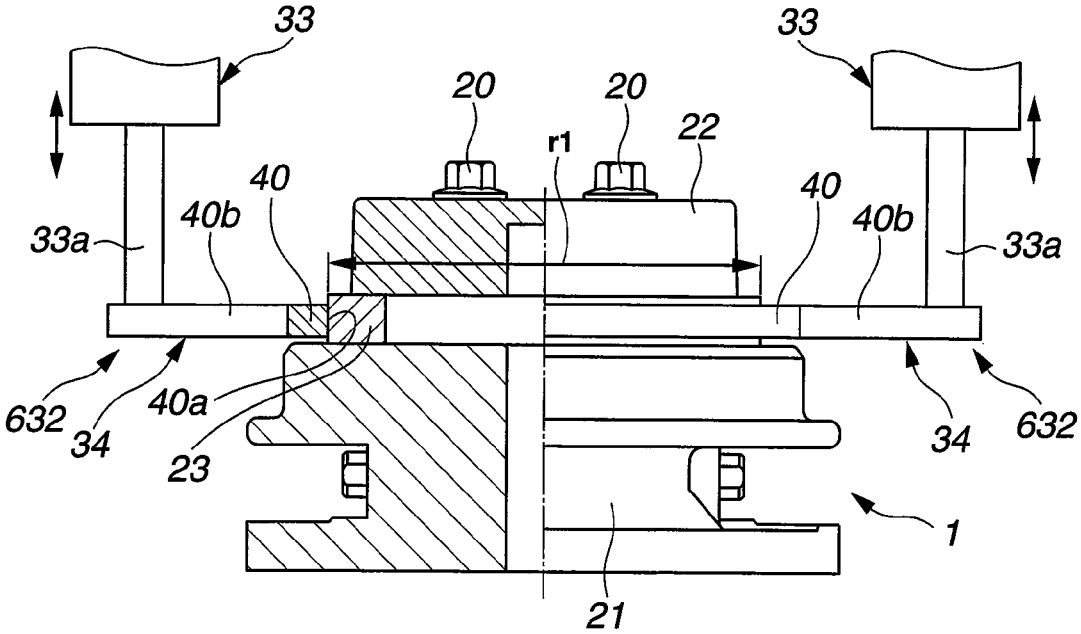
FIG. 18 is a view similar to FIG. 3, but shows the seventh embodiment of the present invention.

Referring to FIG. 17 and FIG. 18, there is shown a seventh embodiment which differs from the first embodiment in construction of cam ring holding device 632. As illustrated in FIG. 17 and FIG. 18, cam ring holding device 632 includes a pair of air cylinders 33, 33 and hold arm 40 that is actuated by air cylinders 33, 33. Air cylinders 33, 33 have the same construction as those of the first embodiment and act in the same manner as explained in the first embodiment. Hold arm 40 is supported at tip end portions of piston rods 33*a*, 33*a* of air cylinders 33, 33 through brackets 40*b*, 40*b*. Further, in this embodiment, the entire radially outer contour of cam ring 23 is larger than the radially outer contour of cover member 22.

As shown in FIG. 17, hold arm 40 is formed into a generally rectangular plate shape and includes retaining hole 40*a* that extends through a central portion of hold arm 40 in a thickness direction of hold arm 40. Retaining hole 40*a* has inner diameter r8 slightly larger than outer diameter r1 of cam ring 23. Hold arm 40 has an annular contact surface that defines retaining hole 40*a*. The contact surface of hold arm 40 is fitable to the entire outer circumferential surface of cam ring 23 and holds the entire outer circumferential surface of cam ring 23. Similar to the first embodiment, before being actuated, hold arm 40 is placed above cam ring 23 that is disposed in the predetermined radial position relative to pump body 21. In this state, retaining hole 40*a* is in alignment with cam ring 23 in the axial direction of cam ring 23. Hold arm 40 is moveable together with piston rods 33*a*, 33*a* in the axial direction of piston rods 33*a*, 33*a*, namely, in the up-and-down direction in FIG. 18.

In this embodiment, the assembling operation of oil pump 1 is performed by the same method as explained in the first embodiment except for the manner of fixing cam ring 23 by cam ring holding device 632. Specifically, after performing the positioning of cam ring 23 by using jig 31, hold arm 40 is downwardly moved until a lower surface of hold arm 40 abuts on the upper end surface of pump body 21. At this time, the annular contact surface of hold arm 40 is fitted to the outer circumferential surface of cam ring 23 and holds the outer circumferential surface of cam ring 23. As a result, cam ring 23 can be restrained from being displaced in the radial direction and fixed to pump body 21 in the predetermined radial position relative to pump body 21 during the coupling operation for coupling cover member 22 to pump body 21.

Accordingly, since the entire radially outer contour of cam ring 23 is larger than the radially outer contour of cover member 22, the advancing operation for advancing hold arm 40 toward cam ring 23 and the retreating operation for retreating hold arm 40 from cam ring 23 can be performed by only moving hold arm 40 in the axial direction of piston rods 33*a*, 33*a*, namely, in the axial direction of cam ring 23. Therefore, cam ring holding device 632 can be structurally simplified and the assembly performance can be enhanced. As a result, the production costs can be reduced.

Figure 19:
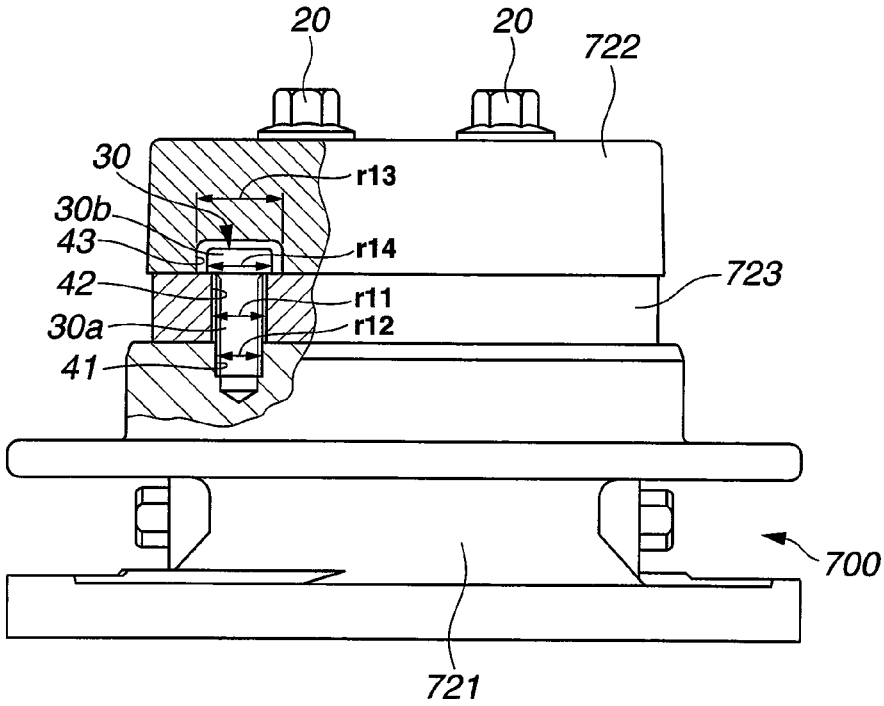
FIG. 19 is a front view of the oil pump having a fixing member for the cam ring of an eighth embodiment of the present invention.

Referring to FIG. 19, there is shown an eighth embodiment which differs from the first embodiment in that cam ring 723 is fixed to pump body 721 in the predetermined radial position relative to pump body 721 by means of a plurality of small-diameter threaded bolts 30 which are provided independently of fastening bolts 20. That is, cam ring 723 is fixed to pump body 721 without using cam ring holding device 32 of the first embodiment. Otherwise, oil pump 700 of this embodiment has substantially the same construction as that of oil pump 1 of the first embodiment except for the fixing structure using threaded bolts 30.

As illustrated in FIG. 19, pump body 721 has a plurality of tapped holes 41 which are formed at predetermined positions on the upper end surface of pump body 721. Cam ring 723 has a plurality of bolt through-holes 42 that are formed corresponding to tapped holes 41 of pump body 721. Cover member 722 has recessed portions 43 that are inwardly recessed from the lower end surface of cover member 722. Recessed portions 43 are formed corresponding to bolt through-holes 42 of cam ring 723 and receive head portions 30*b* of threaded bolts 30 therein, respectively. Recessed portions 43 have inner diameter r13 slightly larger than outer diameter r14 of head portions 30*b* of threaded bolts 30, respectively. Threaded bolts 30 are screwed into tapped holes 41 through bolt through-holes 42, respectively. Bolt through-holes 42 have inner diameter r11 slightly larger than outer diameter r12 of threaded portions 30*a* of threaded bolts 30, respectively. Pin insertion holes 23*b*, 23*b* of cam ring 723 have the inner diameter larger than the outer diameter of positioning pins 28, 28 on pump body 721.

The assembling operation of oil pump 700 is performed in the same manner as described in the first embodiment except for a procedure that is conducted after the positioning of cam ring 723 by using jig 31 and before the retreating of jig 31. Specifically, after performing the positioning of cam ring 723 by using jig 31, cam ring 723 is fixed to pump body 721 by means of threaded bolts 30 while keeping jig 31 mounted on pump body 721 and cam ring 723. Subsequently, jig 31 is retreated, and then rotation shaft 26 with inner rotor 25 and outer rotor 24 are assembled to rotor receiving hole 23*a* of cam ring 723. Next, cover member 722 is placed on the upper surface of cam ring 723 by fitting recessed portions 43 to head portions 30*b* of threaded bolts 30 while engaging positioning recesses 22*b*, 22*b* of cover member 722 with positioning pins 28, 28. Then, similar to the first embodiment, pump body 721, cover member 722 and cam ring 723 are fixed to one another by co-fastening using bolts 20. The assembling operation of oil pump 700 is thus completed.

In this embodiment, cam ring 723 is fixed to pump body 721 by means of threaded bolts 30 after performing the positioning of cam ring 723 using jig 31 and before retreating jig 31. Accordingly, cam ring 723 is allowed to be placed in an optional position relative to pump body 721 before cam ring 723 is fixed to pump body 721 by threaded bolts 30. Namely, the position of cam ring 723 relative to pump body 721 is adjustable before fixing cam ring 723 to pump body 721 by using threaded bolts 30. Further, the positioning of cam ring 723 relative to pump body 721 can be performed without suffering from influence of the machining errors of parts. Therefore, the efficiency in assembling oil pump 700 can be enhanced without increasing the machining accuracy of parts.

Further, cam ring 723 can be rigidly fixed to pump body 721 by threaded bolts 30 and stably held in the predetermined radial position relative to pump body 721. Further, since threaded bolts 30 are used as fixing members for fixing cam ring 723 to pump body 721, the radial position of cam ring 723 relative to pump body 721 can be adjusted by loosing threaded bolts 30 if necessary.

Further, since inner diameter r11 of bolt through-holes 42 of cam ring 723 is slightly larger than outer diameter r12 of threaded portion 30*a* of threaded bolts 30, the position of cam ring 723 relative to threaded bolts 30 can be readily adjusted. Further, bolt through-holes 42 can be formed without high accuracy in position, and therefore, the machining work for forming cam ring 723 can be enhanced, serving for suppressing increase in the production costs.

Further, the fixing operation for fixing cam ring 723 to pump body 721 is preformed independently of co-fastening cam ring 723 and cover member 722 to pump body 721 by bolts 20. Therefore, upon conducting the maintenance work of oil pump 700, after dismounting cover member 722 by loosing bolts 20, outer and inner rotors 24, 25 and rotation shaft 26 can be disassembled from pump body 721 without causing displacement of cam ring 723. This serves for facilitating the maintenance work. Further, when outer and inner rotors 24, 25 and rotation shaft 26 are re-assembled to pump body 721 after the maintenance work, it is not necessary to perform the positioning operation of cam ring 723 relative to pump body 721 again.

Furthermore, since inner diameter r5 of pin insertion holes 23*b*, 23*b* of cam ring 723 is larger than outer diameter r6 of positioning pins 28, 28 on pump body 721, positioning pins 28, 28 can be radially moved within pin insertion holes 23*b*, 23*b*. Accordingly, the radial position of cam ring 723 relative to pump body 721 can be adjusted. Further, the rough positioning of cam ring 723 relative to pump body 721 can be performed, serving for enhancing the efficiency in positioning of cam ring 723.

Figure 20:
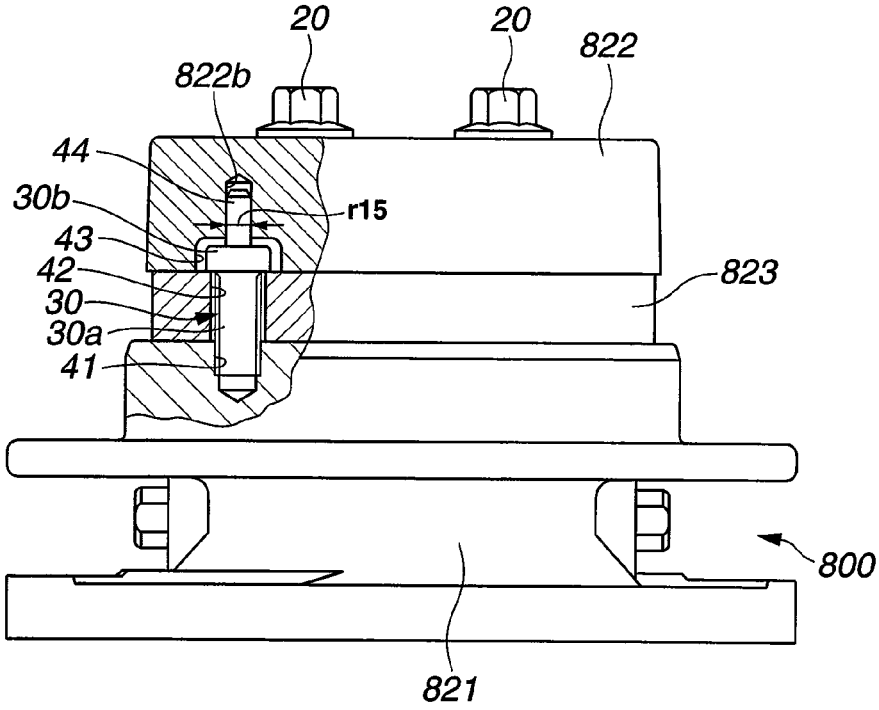
FIG. 20 is a view similar to FIG. 19, but shows a ninth embodiment of the present invention.

Referring to FIG. 20, there is shown a ninth embodiment which differs from the eighth embodiment in provision of projections 44 on head portion 30*b* of threaded bolts 30 and positioning recesses 822*b* in cover member 822 instead of positioning pins 28 and positioning recesses 22*b*, respectively. As illustrated in FIG. 20, each of projections 44 extends from a top of head portion 30*b* of each of threaded bolt 30 in an axial direction of threaded bolt 30. Projections 44 are fitable to positioning recesses 822*b*. Each of positioning recesses 822*b* is formed at a bottom of each of recessed portions 43 of cover member 822 corresponding to each of projections 44. Outer diameter r15 of projections 44 may be substantially the same as outer diameter r6 of positioning pins 28 of the eighth embodiment.

The ninth embodiment can perform the same function and effect as those of the eighth embodiment. In addition, in the ninth embodiment, with the provision of projections 44 of threaded bolt 30, the positioning of cover member 822 can be readily performed. Further, it is possible to omit the machining work for forming positioning holes 21*c* of pump body 822 and pin insertion holes 23*b* of cam ring 823 and the insertion work for inserting positioning pins 28 into positioning holes 21*c* and pin insertion holes 23*b*. Therefore, the assembling operation of oil pump 800 can be further facilitated.

Figure 21:
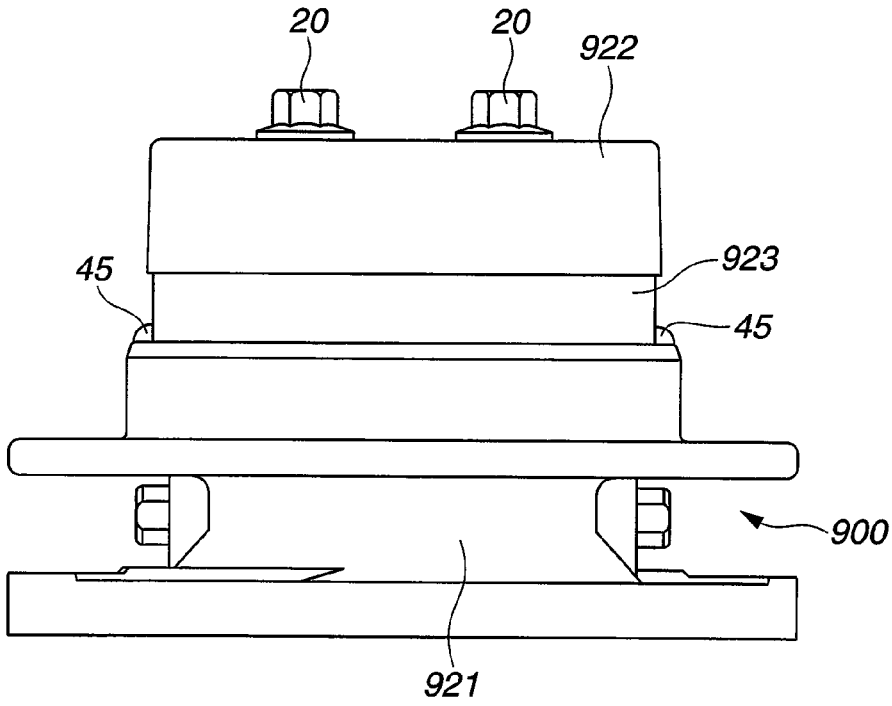
FIG. 21 is a view similar to FIG. 19, but shows a tenth embodiment of the present invention.

Referring to FIG. 21, there is shown a tenth embodiment which differs from the eighth embodiment in that cam ring 923 is fixed to pump body 921 by a weld that is provided at a boundary between mutually contact portions of pump body 921 and cam ring 923, instead of threaded bolts 30 of the eighth embodiment. Specifically, in this embodiment, cam ring 923 and pump body 921 are made of an iron-based material, and cam ring 923 is fixed to pump body 921 by a plurality of welds 45. As illustrated in FIG. 21, welds 45 are provided at a boundary between mutually contact portions of the upper end surface of pump body 921 and the lower surface of cam ring 923. Namely, welds 45 are provided along the outer circumferential periphery of the lower surface of cam ring 923 contacted with the upper end surface of pump body 921. Welds 45 are disposed at optional intervals in the circumferential direction of cam ring 923. Cam ring 923 and pump body 921 are fixedly connected with each other through welds 45.

The assembling operation of oil pump 900 of this embodiment is performed in the same manner as described in the eighth embodiment except for fixing cam ring 923 to pump body 921 by spot welding. Specifically, after performing the positioning of cam ring 923 by using jig 31, cam ring 923 is fixed to pump body 921 by providing welds 45 at the optional intervals at the boundary between the mutually contact portions of the upper end surface of pump body 921 and the lower surface of cam ring 923, while keeping jig 31 mounted on pump body 921 and cam ring 923.

In this embodiment, with the provision of welds 45, cam ring 923 can be more rigidly fixed to pump body 921 through welds 45. Accordingly, cam ring 923 can be more stably held in the predetermined radial position relative to pump body 921. Further, it is not necessary to use other fixing members, such as bolts, for fixing cam ring 923 to pump body 921. Therefore, increase in production costs can be suppressed and the fixing operation for fixing cam ring 923 to pump body 921 can be readily performed. As a result, the efficiency in assembling oil pump 900 can be enhanced.

Figure 22:
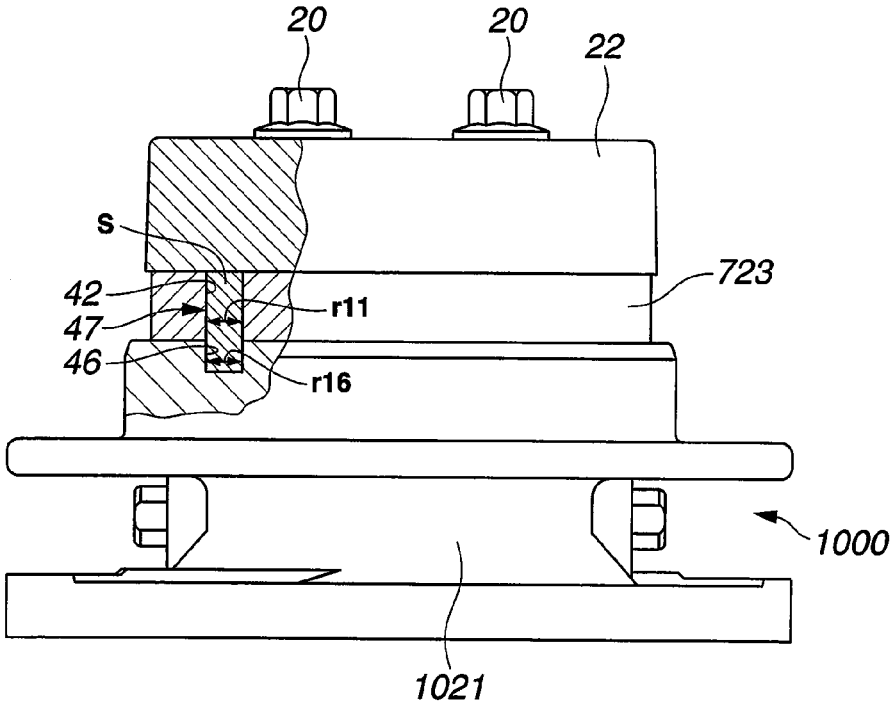
FIG. 22 is a view similar to FIG. 19, but shows an eleventh embodiment of the present invention.

Referring to FIG. 22, there is shown an eleventh embodiment which differs from the eighth embodiment in that a plurality of recessed portions 46 are formed in pump body 1021 instead of tapped holes 41 of pump body 721 of the eighth embodiment, and filler 47 is filled in space S between respective recessed portions 46 of pump body 1021 and respective bolt through-holes 42 of cam ring 723. As illustrated in FIG. 22, recessed portions 46 are formed on the upper end surface of pump body 1021 of oil pump 1000. Each of recessed portions 46 has a closed-end cylindrical shape and is aligned and communicated with each of bolt through-holes 42 of cam ring 723. Inner diameter r16 of recessed portion 46 is substantially the same as inner diameter r11 of bolt through-hole 42. Recessed portion 46 and bolt through-hole 42 cooperate to define space S therebetween in which filler 47 is to be filled. In this embodiment, filler 47 is made of a thermosetting resin. Cam ring 723 is fixed to pump body 1021 through filler 47.

The assembling operation of oil pump 1000 of this embodiment is performed in the same manner as described in the eighth embodiment except for fixing cam ring 723 to pump body 1021 by filler 47. Specifically, after performing the positioning of cam ring 723 by using jig 31, the thermosetting resin in a molten state is poured from an upper opening of each of bolt through-holes 42 into space S until space S is filled with the thermosetting resin. The thermosetting resin is then cured by heating and serves as filler 47. Thus, cam ring 723 is fixedly connected to pump body 1021 through filler 47.

In this embodiment, the fixing operation for fixing cam ring 723 to pump body 1021 can be readily performed by simply filling space S with the thermosetting resin after performing the positioning of cam ring 723 using jig 31 and before retreating jig 31. Accordingly, the efficiency in assembling oil pump 1000 can be enhanced.

Figure 23:
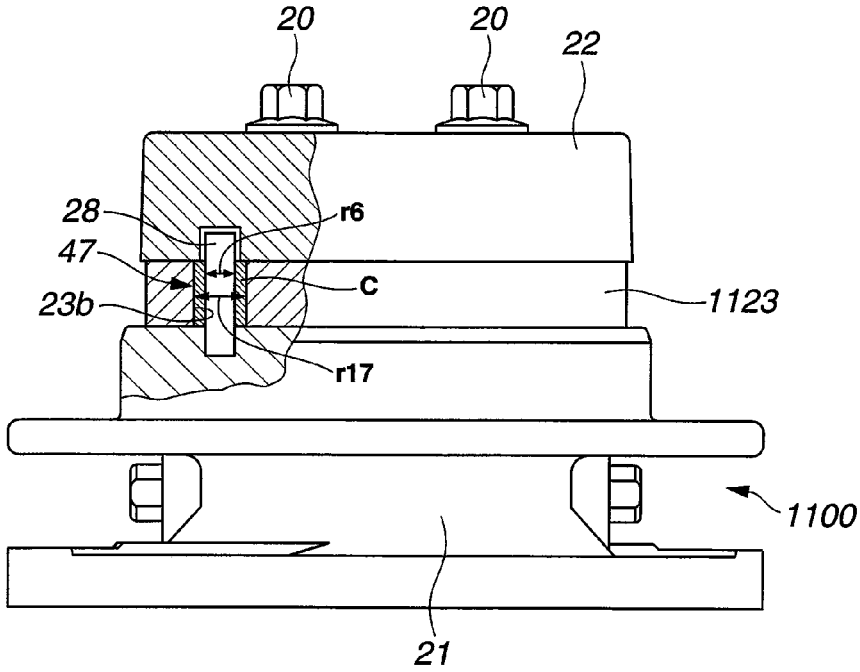
FIG. 23 is a view similar to FIG. 19, but shows a twelfth embodiment of the present invention.

Referring to FIG. 23, there is shown a twelfth embodiment which differs from the eleventh embodiment in arrangement of filler 47 and omission of recessed portions 46 of pump body 1021 and bolt through-holes 42 of cam ring 723 in the eleventh embodiment. As illustrated in FIG. 23, filler 47 is provided in clearance C that is defined between an inner circumferential surface of each of pin insertion holes 23*b* of cam ring 1123 and an outer circumferential surface of each of positioning pins 28 that is inserted into pin insertion hole 23*b*. Pin insertion holes 23*b* have inner diameter r17 that is larger than inner diameter r5 in the eleventh embodiment so as to form clearance C larger than the clearance formed in the eleventh embodiment. Cam ring 1123 is fixed to pump body 21 through filler 47.

The assembling operation of oil pump 1100 of this embodiment is performed in the same manner as described in the eighth embodiment except for providing filler 47 in clearance C between pin insertion holes 23*b* of cam ring 1123 and positioning pins 28. Specifically, after performing the positioning of cam ring 1123 by using jig 31, the thermosetting resin in a molten state is poured from an upper opening of each of pin insertion holes 23*b* into clearance C until clearance C is filled with the thermosetting resin. The thermosetting resin is then cured by heating to form filler 47. Thus, cam ring 1123 is fixedly connected to pump body 21 through filler 47.

The twelfth embodiment can perform the same function and effect as those of the eleventh embodiment. In addition, the rough positioning of cam ring 1123 relative to pump body 21 can be performed by using positioning pins 28 and pin insertion holes 23*b*. Therefore, the efficiency in positioning of cam ring 1123 can be enhanced. Further, in the twelfth embodiment, unlike the eleventh embodiment, it is not necessary to form recessed portions in pump body 21 and bolt through-holes in cam ring 1123 which cooperate to define space S therebetween. Accordingly, the number of production processes can be reduced, thereby effectively suppressing increase in the production cost.

Figure 24:
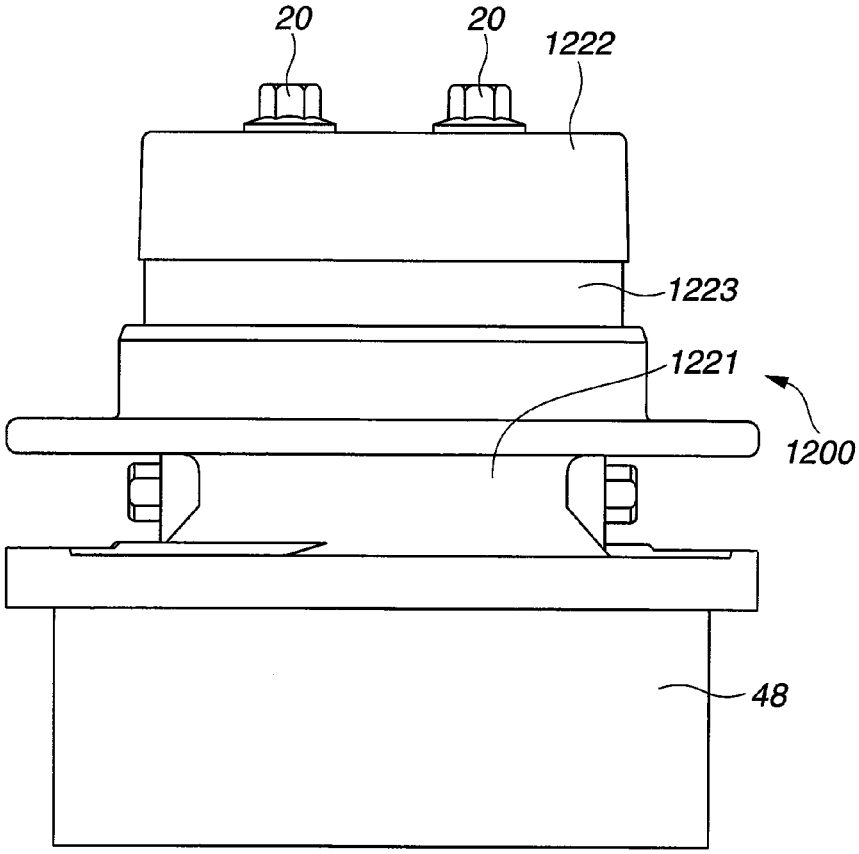
FIG. 24 is a front view of the oil pump and the cam ring holding device of a thirteenth embodiment of the present invention.

Referring to FIG. 24, there is shown a thirteenth embodiment which differs from the first embodiment in that pump body 1221 and cam ring 1223 are made of magnetic material, cover member 1222 and jig 31 are made of non-magnetic material, and electromagnet 48 is used for fixing cam ring 1223 to pump body 1221 in the predetermined radial position relative to pump body 1221 instead of cam ring holding device 32 of the first embodiment.

The assembling operation of oil pump 1200 of this embodiment is performed in the same manner as described in the first embodiment except for fixing cam ring 1223 to pump body 1221 in the predetermined radial position relative to pump body 1221 by contacting electromagnet 48 with pump body 1221. Specifically, first, electromagnet 48 is contacted with pump body 1221. Next, similar to the first embodiment, cam ring 1223 is placed on pump body 1221 and moved to the predetermined radial position relative to pump body 1221 by using jig 31. Subsequently, electromagnet 48 is energized to produce magnetic force and magnetically attract cam ring 1223 to pump body 1221. Cam ring 1223 is thus fixed to pump body 1221 in the predetermined radial position relative to pump body 1221. Thereafter, jig 31 is retreated, rotation shaft 26 with inner rotor 25 and outer rotor 24 are assembled into rotor receiving hole 23*a* of cam ring 1223. Cover member 1222 is placed on cam ring 1223, and then pump body 1221, cam ring 1223 and cover member 1222 are fixed to one another by co-fastening using bolts 20. Finally, electromagnet 48 is deenergized and retreated from pump body 1221. Thus, the assembling operation of oil pump 1200 is completed.

Accordingly, in the thirteenth embodiment, unlike the first to seventh embodiments, it is not necessary to use a cam ring holding device for fixing the cam ring to the pump body. Further, in the thirteenth embodiment, unlike the eighth, ninth, eleventh and twelfth embodiments, it is not necessary to use fixing members for fixing the cam ring to the pump body. Further, in the thirteenth embodiment, unlike the tenth embodiment, it is not necessary to use welding for fixing the cam ring to the pump body. Therefore, in the thirteenth embodiment, cam ring 1223 can be readily fixed to pump body 1221 in the predetermined radial position relative to pump body 1221.

Further, since both cam ring 1223 and pump body 1221 are made of magnetic material, pump body 1221 can be magnetized using electromagnet 48 to thereby enhance the fixing force acting on cam ring 1223. As a result, cam ring 1223 can be surely fixed to pump body 1221 in the predetermined radial position relative to pump body 1221.

Further, since cover member 1222 and jig 31 are made of non-magnetic material, cover member 1222 and jig 31 can be free from being influenced by the magnetic force of electromagnet 48. Accordingly, cam ring 1223 can be surely fixed to pump body 1221 without causing deterioration in the assembling efficiency.

Furthermore, a magnet may be used instead of electromagnet 48. In such a case, after performing the positioning of cam ring 1223 by using jig 31, the magnet is contacted with pump body 1221 while jig 31 is kept mounted to pump body 1221 and cam ring 1223. Cam ring 1223 is thus fixed to pump body 1221 in the predetermined radial position relative to pump body 1221 by the magnetic force of the magnet. Next, jig 31 is retreated. Rotation shaft 26 with inner rotor 25 and outer rotor 24 are assembled into rotor receiving hole 23*a* of cam ring 1223. Subsequently, cover member 1222 is placed on cam ring 1223, and then pump body 1221, cam ring 1223 and cover member 1222 are fixed to one another by co-fastening using bolts 20. Finally, the magnet is retreated from pump body 1221. In this case, the same function and effect as those in the case using electromagnet 48 can be obtained.

Figure 25:
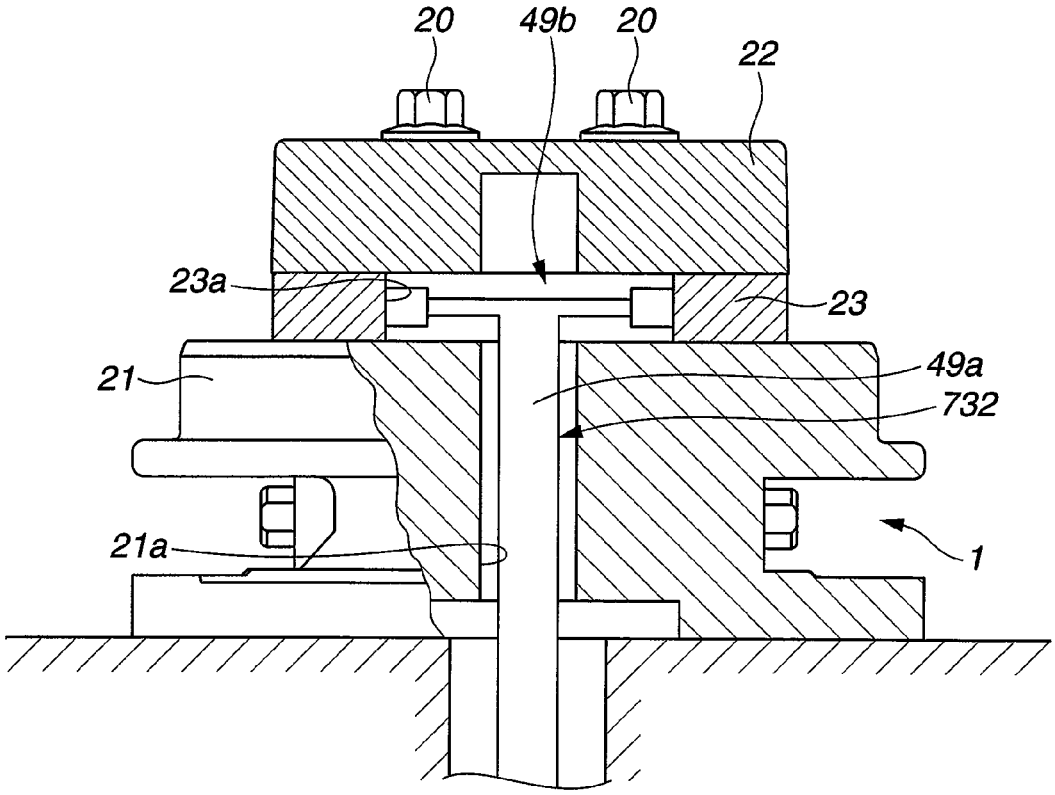
FIG. 25 is a front view of the oil pump and the cam ring holding device of a fourteenth embodiment of the present invention.

Referring to FIG. 25, there is shown a fourteenth embodiment which differs in construction of cam ring holding device 732 from the first embodiment. As illustrated in FIG. 25, rotation shaft insertion hole 21*a* of pump body 21 extends through pump body 21, through which cam ring holding device 732 extends. Rotor receiving hole 23*a* of cam ring 23 is disposed corresponding to rotation shaft insertion hole 21*a* and open to the lower surface of cam ring 23 which is opposed to pump body 21. In this embodiment, the clamped portion of cam ring 23 is disposed in rotor receiving hole 23*a*.

Specifically, upon assembling oil pump 1, cam ring holding device 732 is disposed inside of pump body 21 and cam ring 23, namely, inside of rotation shaft insertion hole 21*a* of pump body 21 and rotor receiving hole 23*a* of cam ring 23. Cam ring holding device 732 includes actuator 49*a* and hold arm 49*b* actuated by actuator 49*a*. Actuator 49*a* extends through rotation shaft insertion hole 21*a* into rotor receiving hole 23*a*. Hold arm 49*b* is disposed within rotor receiving hole 23*a*. Hold arm 49*b* is constructed to be extendable from an upper end portion of actuator 49*a* in a radially outward direction of cam ring 23 at an optional time such that opposed radial outer ends of hold arm 49*b* contact and presses the inner circumferential surface of cam ring 23 which defines rotor receiving hole 23*a*. The inner circumferential surface of cam ring 23 serves as the clamped portion of cam ring 23.

In this embodiment, cam ring 23 is held in the predetermined radial position relative to pump body 21 from the radial inside of cam ring 23 by cam ring holding device 732. Cam ring 23 can be prevented from being displaced in the radial direction and fixed to pump body 21. Increase in dimension of cam ring 23 can be suppressed, thereby serving for downsizing of oil pump 1.

Figure 26:
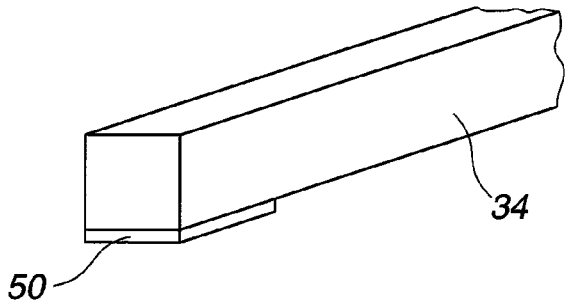
FIG. 26 is a perspective view of a modification of the cam ring holding device of the first, second and fifth embodiments of the present invention.

Referring to FIG. 26, there is shown a modification of hold arms 34, 34 of cam ring holding device 32 of the first, second and fifth embodiments. FIG. 26 shows only one of hold arms 34, 34 for the sake of simple illustration. As shown in FIG. 26, hold arm 34 includes elastic member 50 that is attached to the lower surface of hold arm 34, i.e., a contact surface that comes into contact with the upper end surface of cam ring 23. Elastic member 50 is formed into a thin plate shape. Elastic member 50 acts to remarkably increase static friction force that is caused between the contact surface of hold arm 34 and the upper surface of cam ring 23.

With the provision of elastic member 50, cam ring 23 can be stiffly fixed to pump body 21 in the predetermined radial position relative to pump body 21. The modification can be applied to slides 39*b*, 39*b* of hold arms 334, 334 of cam ring holding device 332 of the fourth embodiment.

Further, elastic member 50 is deformable due to the pressing force of hold arms 34, 34 and comes into intimate contact with the upper surface of cam ring 23. Accordingly, it is possible to ensure the contact area of hold arms 34, 34 relative to the upper surface of cam ring 23 regardless of flatness of the upper surface of cam ring 23 or a degree of parallelness of the lower surface of hold arms 34, 34 and the upper surface of cam ring 23. As a result, stable static friction force that is caused between the upper surface of cam ring 23 and the lower surface of hold arms 34, 34 can be obtained.

Further, this modification can be applied to hold arms 234, 234 of the third embodiment and hold arms 534, 534 of the sixth embodiment. That is, elastic member 50 may be attached to contact surfaces 37, 37 of hold arms 234, 234 and the contact surfaces of hold arms 534, 534. In such a case, cam ring 223, 523 can be stiffly fixed to pump body 21 in the predetermined radial position relative to pump body 21 by the above-described stable static friction force. Further, in the sixth embodiment, even in a case where the contact area of the respective contact surfaces of hold arms 534, 534 is small, a relatively large fixing force of hold arms 534, 534 can be ensured. Therefore, the width of hold arms 534, 534 can be set smaller than outer diameter r1 of cam ring 523.

Further, in the above embodiments, outer diameter r1 of the cam ring may be larger than outer diameter of the upper end surface of the pump body. Further, in the second to sixth embodiments, even in a case where outer diameter r1 of the cam ring is smaller than outer diameter r2 of the cover member, the cam ring can be fixed to the pump body by the hold arms of the cam ring holding device. Further, in the eighth to thirteenth embodiments, it is not necessary to use the cam ring holding device. Accordingly, in the second to sixth embodiments and the eighth to thirteenth embodiments, outer diameter r1 of the cam ring may be optionally varied.

Further, in the second embodiment, the shape of projections 35, 35 of cam ring 123 is not limited to the rectangular shape and may be formed into various other optional shapes. Further, projections 35, 35 may project radially outwardly from the upper end surface of pump body 21. The shape and the amount of projection of projections 35, 35 may be suitably varied in view of balance between the holding performance of cam ring holding device 32 and the weight of cam ring 123.

Further, in the third embodiment, an inclination of tapered contact surface 36 of cam ring 223 with respect to the axis of cam ring 223 may be optionally varied depending on the holding force of cam ring holding device 232 which acts to cam ring 223. Further, an outer diameter of cam ring 223 at the upper end periphery may be smaller than outer diameter r2 of cover member 22, and an outer diameter of cam ring 223 at the lower end periphery may be larger than the outer diameter of the upper end surface of pump body 21. Accordingly, the inclination of tapered contact surface 36 of cam ring 223 may be suitably varied in view of balance between the clamping performance of cam ring holding device 232 and the weight of cam ring 223.

Further, in the eleventh and twelfth embodiments, the material of filler 47 is not limited to the thermosetting resin, and may be other curable resin, for instance, an ultraviolet (UV) light curable resin.

This application is based on a prior Japanese Patent Application No. 2006-339360 filed on Dec. 18, 2006. The entire contents of the Japanese Patent Application No. 2006-339360 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A method of assembling an oil pump, the oil pump including a first housing having a rotation shaft insertion hole, a cam ring disposed on the first housing, the cam ring having a generally cylindrical inner circumferential surface, a pump element that is rotatably disposed within the cam ring and performs suction and discharge of a working oil during rotation, a rotation shaft that rotatably extends through the rotation shaft insertion hole of the first housing and rotatively drives the pump element, and a second housing disposed on the cam ring on a side opposed to the first housing in an axial direction of the rotation shaft, the method comprising:

a first step of placing the cam ring on the first housing;

a second step of mounting a jig to the first housing and the cam ring which determines a position of the cam ring relative to the rotation shaft insertion hole of the first housing;

a third step of fixing the first housing and the cam ring to each other;

a fourth step of retreating the jig;

a fifth step of assembling the pump element and the rotation shaft into the cam ring; and a sixth step of placing the second housing on the cam ring on the side opposed to the first housing and fixing the first housing, the cam ring and the second housing to one another, wherein the jig has a large diameter portion fitted into the generally cylindrical inner circumferential surface of the cam ring and a small diameter portion fitted into the rotation shaft insertion hole of the first housing.

2. The method as claimed in claim 1, wherein in the third step, the first housing and the cam ring are fastened to each other by means of a bolt.

3. The method as claimed in claim 2, wherein the bolt comprises a projection that is formed on a head portion of the bolt, and the second housing comprises a positioning recess that is formed corresponding to the projection of the bolt.

4. The method as claimed in claim 1, wherein in the third step, the first housing and the cam ring are fixed to each other by welding.

5. The method as claimed in claim 1, wherein in the third step, the first housing and the cam ring are fixed to each other by a filler that is filled in a space between the first housing and the cam ring.

6. The method as claimed in claim 1, wherein the oil pump further comprises a positioning pin disposed on an end surface of the first housing which is opposed to the cam ring, and the cam ring comprises a pin insertion hole through which the positioning pin extends, and wherein in the third step of the method, the first housing and the cam ring are fixed to each other by a filler that is filled in a clearance between an outer circumferential surface of the positioning pin and an inner circumferential surface of the pin insertion hole.

7. The method as claimed in claim 1, wherein the small diameter portion of the jig is eccentric with respect to the large diameter portion of the jig.

* * * * *